US010570687B2

(12) United States Patent
Davis et al.

(10) Patent No.: US 10,570,687 B2
(45) Date of Patent: Feb. 25, 2020

(54) RECLOSABLE MULTI-ZONE ISOLATION USING A PISTON ASSEMBLY HAVING A LOCK OUT FEATURE

(71) Applicant: Halliburton Energy Services, Inc., Houston, TX (US)

(72) Inventors: Jason Earl Davis, Columbia, NC (US); William David Henderson, Tioga, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 16/064,124

(22) PCT Filed: Mar. 7, 2016

(86) PCT No.: PCT/US2016/021196
§ 371 (c)(1),
(2) Date: Jun. 20, 2018

(87) PCT Pub. No.: WO2017/155503
PCT Pub. Date: Sep. 14, 2017

(65) Prior Publication Data

US 2018/0371858 A1 Dec. 27, 2018

(51) Int. Cl.
*E21B 34/10* (2006.01)
*E21B 43/14* (2006.01)
(Continued)

(52) U.S. Cl.
CPC ..... *E21B 23/04* (2013.01); *E21B 34/14* (2013.01)

(58) Field of Classification Search
None
See application file for complete search history.

(56) References Cited

U.S. PATENT DOCUMENTS 6,230,811 B1 5/2001 Ringgenberg et al.
6,983,795 B2 1/2006 Zuklic et al.
(Continued)

FOREIGN PATENT DOCUMENTS

WO WO 2007/131134 A2 11/2007
WO WO 2015/119727 A1 8/2015

OTHER PUBLICATIONS

International Search Report and the Written Opinion of the International Search Authority, or the Declaration, dated Nov. 30, 2016, PCT/US2016/021200, 16 pages, ISA/KR.
(Continued)

*Primary Examiner* — Matthew R Buck
*Assistant Examiner* — Douglas S Wood

(57) ABSTRACT

A reclosable multi-zone isolation tool including a piston assembly with a lock out feature. The tool has an outer and inner tubular having an annular flow path defined there between, and a central flow path defined by the inner tubular. The annular flow path is in fluid communication with the first zone, while the central flow path is in fluid communication with the second zone. A sleeve is positioned in the annular flow path and axially moveable between an open and closed position. A mandrel is positioned within the inner tubular and coupled to the sleeve to actuate the sleeve between the open and closed position. A pressure responsive piston assembly is coupled to the mandrel in order to actuate the sleeve to the open position. Once in the open position, the piston assembly is "locked out," thereby allowing the mandrel and sleeve to move relative to the piston between the open and closed positions.

12 Claims, 15 Drawing Sheets

Run - Closed

(51) Int. Cl.

| | |
|---|---|
| ***E21B 43/12*** | (2006.01) |
| ***E21B 34/06*** | (2006.01) |
| ***E21B 19/16*** | (2006.01) |
| ***E21B 17/02*** | (2006.01) |
| ***E21B 23/04*** | (2006.01) |
| ***E21B 34/14*** | (2006.01) |

(56) References Cited

U.S. PATENT DOCUMENTS

| | | | | |
|---|---|---|---|---|
| 7,210,534 | B2 | 5/2007 | Hayter et al. | |
| 8,522,877 | B2 | 9/2013 | Chambers et al. | |
| 8,757,275 | B2 * | 6/2014 | Scott | E21B 33/127 166/374 |
| 2003/0019634 | A1 | 1/2003 | Henderson et al. | |
| 2007/0119598 | A1 | 5/2007 | Turner et al. | |
| 2011/0209873 | A1 | 9/2011 | Stout | |
| 2014/0020912 | A1 | 1/2014 | Scott et al. | |
| 2015/0218906 | A1 | 8/2015 | Clem et al. | |
| 2015/0330184 | A1 | 11/2015 | Ringgenberg | |

OTHER PUBLICATIONS

International Search Report and the Written Opinion of the International Search Authority, or the Declaration, dated Dec. 5, 2016, PCT/US2016/021196, 17 pages, ISA/KR.

* cited by examiner

Initially Opened
(Collet Disengaged)

Fully Opened
(Sliding Sleeve Bottomed Out)

Open-Lugs Disengaged and Piston Locked Out

Re-Closed

Open Configuration

Run - Closed

Open

Re-Closed

Run - Closed

Open

Re-Closed

Run - Closed

Open

Open - Piston Locked Out

Re-Closed

Open

Re-Closed

RECLOSABLE MULTI-ZONE ISOLATION USING A PISTON ASSEMBLY HAVING A LOCK OUT FEATURE

PRIORITY

The present application is a U.S. National Stage patent application of International Patent Application No. PCT/US2016/021196, filed on Mar. 7, 2016, the benefit of which is claimed and the disclosure of which is incorporated herein by reference in its entirety.

FIELD OF THE DISCLOSURE

The present disclosure relates generally to subterranean wellbore operations and, more specifically, to reclosable multi-zone isolation tools utilizing piston assemblies having a lock out feature.

BACKGROUND

It is common to encounter hydrocarbon wells that traverse more than one separate subterranean hydrocarbon bearing zone. In such wells, the separate zones may have similar or different characteristics. For example, the separate zones may have significantly different formation pressures. Even with the different pressures regimes, it may nonetheless be desirable to complete each of the zones prior to producing the well. In such cases, it may be desirable to isolate certain of the zones from other zones after completion.

For example, when multiple productive zones that have significantly different formation pressures are completed in a single well, hydrocarbons from a high pressure zone may migrate to a lower pressure zone during production. It has been found, however, that this migration of hydrocarbons from one zone to another may decrease the ultimate recovery from the well. One way to overcome this fluid loss from a high pressure zone into a lower pressure zone during production and to maximize the ultimate recovery from the well is to initially produce only the high pressure zone and delay production from the lower pressure zone. Once the formation pressure of the high pressure zone has decreased to that of the lower pressure zone, the two zones can be produced together without any loss of reserves. It has been found, however, that from an economic perspective, delaying production from the lower pressure zone while only producing from the high pressure zone may be undesirable.

DESCRIPTION OF ILLUSTRATIVE EMBODIMENTS

Illustrative embodiments and related methods of the present disclosure are described below as they might be employed in reclosable multi-zone isolation apparatuses that employ a lock open feature. In the interest of clarity, not all features of an actual implementation or methodology are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methodologies of the disclosure will become apparent from consideration of the following description and drawings.

As described herein, illustrative embodiments and methods of the present disclosure are directed to reclosable multi-zone isolation tools having a piston assembly with a lock out feature. In general, the tool includes an outer and inner tubular having an annular flow path defined there between, and a central flow path defined by the inner tubular. The annular flow path is in fluid communication with an upper zone, while the central flow path is in fluid communication with a lower zone. A sleeve is positioned in the annular flow path and axially moveable between an open and closed position. A mandrel is slidingly positioned within the inner tubular and coupled to the sleeve to thereby actuate the sleeve between an open and closed position. A pressure responsive piston assembly is selectively coupled to the mandrel in order to actuate the sleeve to the open position. Once in the open position, the piston assembly is "locked out," thereby allowing the mandrel and sleeve to move relative to the piston between the open and closed positions. Thus, in certain embodiments, the piston assembly will no longer act on the mandrel or sleeve after it becomes locked out. Accordingly, by preventing unintentional reclosing of the sleeve by the piston assembly, a more reliable isolation tool is provided.

Figure 1:
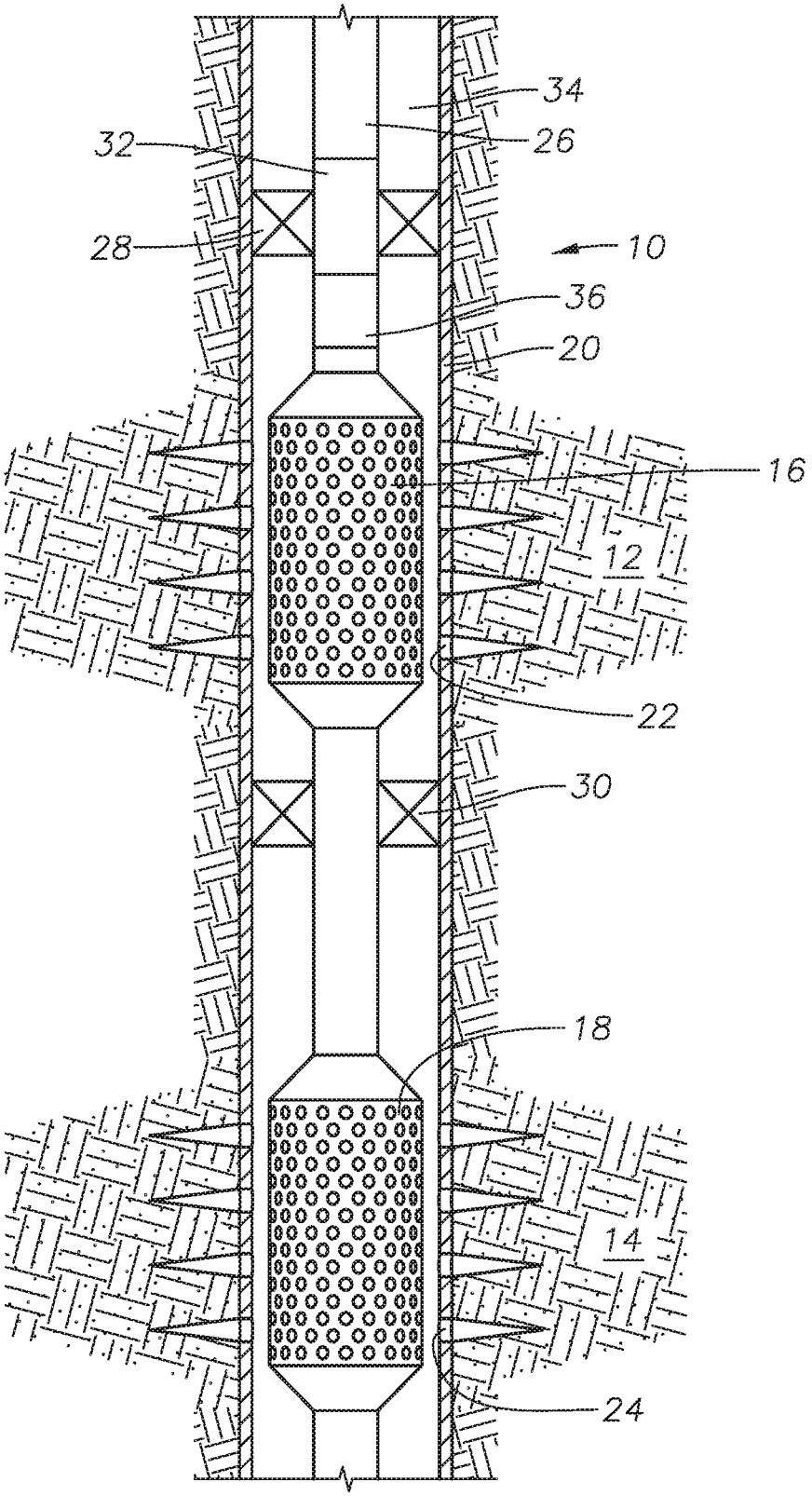
FIG. 1 shows a multi zone isolation apparatus/tool positioned along a cased wellbore, according to certain illustrative embodiments of the present disclosure.

Referring initially to FIG. 1, an illustrative multi zone isolation apparatus/tool of the present disclosure is disposed within a cased wellbore that is generally designated 10. Wellbore 10 is illustrated intersecting two separate hydrocarbon bearing zones, upper zone 12 and lower zone 14. For purposes of description, only two zones are shown but it is understood that the present disclosure has application to isolate any number of zones within a well. As mentioned, while wellbore 10 is illustrated as a vertical cased well with two producing zones, illustrative embodiments of the present disclosure are applicable to horizontal and inclined wellbores with more than two producing zones and in uncased wells.

A completion string disposed within wellbore 10 includes upper and lower sand screen assemblies 16, 18 that are located proximate to zones 12, 14, respectively. Wellbore 10 includes a casing string 20 that has been perforated at locations 22, 24 to provide fluid flow paths into casing 20 from zones 12, 14, respectively. The completion string includes production tubing 26, packers 28, 30 and a cross-over sub 32 to enable fluid flow between the interior of the completion string and annulus 34.

The completion string also includes multi zone isolation tool 36, according to certain illustrative embodiments of the present disclosure. As explained in greater detail below, tool 36 functions to connect lower sand screen assembly 18 and production tubing 26 via a first flow path. Tool 36 also functions to selectively isolate and connect upper sand screen assembly 16 to annulus 34 via a second flow path. Thus, tool 36 selectively isolates zone 12 and zone 14 and allows zones 12, 14 to be independently produced.

Referring next to FIGS. 2A-2D, therein is depicted a multi zone isolation tool according to certain illustrative embodiments of the present disclosure, generally designated 100. Tool 100 includes a substantially tubular outer housing assembly 102 that is formed from a plurality of housing members that are securably and sealingly coupled together by threading, set screws or similar technique. In certain illustrative embodiments, housing assembly 102 includes an upper housing member 104, a first upper intermediate housing member 106, a second upper intermediate housing member 108 having a housing extension 110, a housing coupling 112, a sleeve housing member 114 that forms a substantially annular pocket 116 with housing extension 110, a lower intermediate housing member 118, a housing coupling 120 and a lower housing member 122. As will be understood by those ordinarily skilled in the art having the benefit of this disclosure, although a particular arrangement of housing members is depicted and described, other arrangements of housing members are possible and are considered within the scope of the present disclosure.

Disposed within housing assembly 102 is an inner tubular assembly 124 that is formed from a plurality of tubular members that are securably and sealingly coupled together by threading, set screws or similar technique. In the illustrated embodiment, inner tubular assembly 124 includes an upper tubular member 126 having a polished bore receptacle 128, an intermediate tubular member 130 having a radially expanded region 132, communication sub 111 and piston housing 115. As mentioned above, those same ordinarily skilled persons will understand that, although a particular arrangement of tubular members is depicted and described, other arrangements of tubular members are possible and are considered within the scope of the present disclosure. For example, in certain embodiments, the same or other components may jointly make up the inner or outer tubular assemblies.

Slidably disposed within tubular assembly 124 is a mandrel assembly 150 that is formed from a plurality of mandrel members that are securably and sealingly coupled together by threading, set screws or similar technique. In the illustrated embodiment, mandrel 150 includes profiles 154 and carries one or more lugs 160 at its lower end. Disposed between inner tubular assembly 124 and mandrel assembly 150 is a communication sub 111 in fluid communication with control line 184. Together, tubular assembly 124 and mandrel 150 define a central flow path 172 that extends between the upper and lower ends of tool 100. As previously described with reference to FIG. 1, central flow path 172 is in fluid communication with lower sand screen assembly 18 and therefore lower zone 14.

Figure 2A:
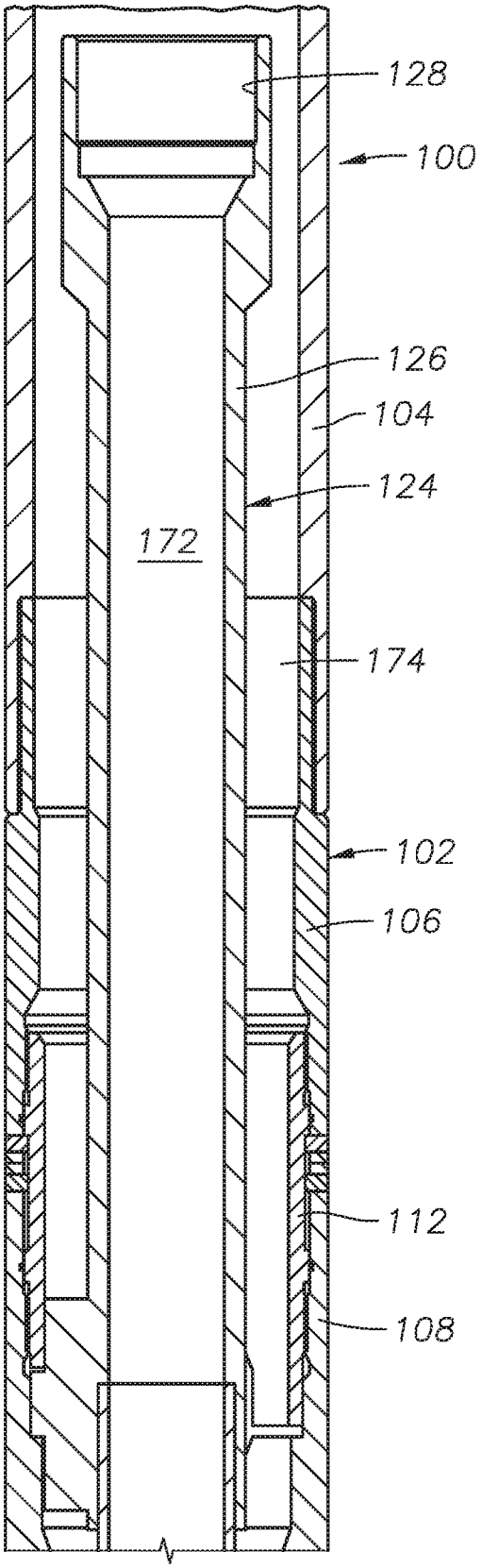
FIGS. 2A-2I show various views of a multi-zone isolation tool in various sleeve positions, according to certain illustrative embodiments of the present disclosure.
Figure 2B:
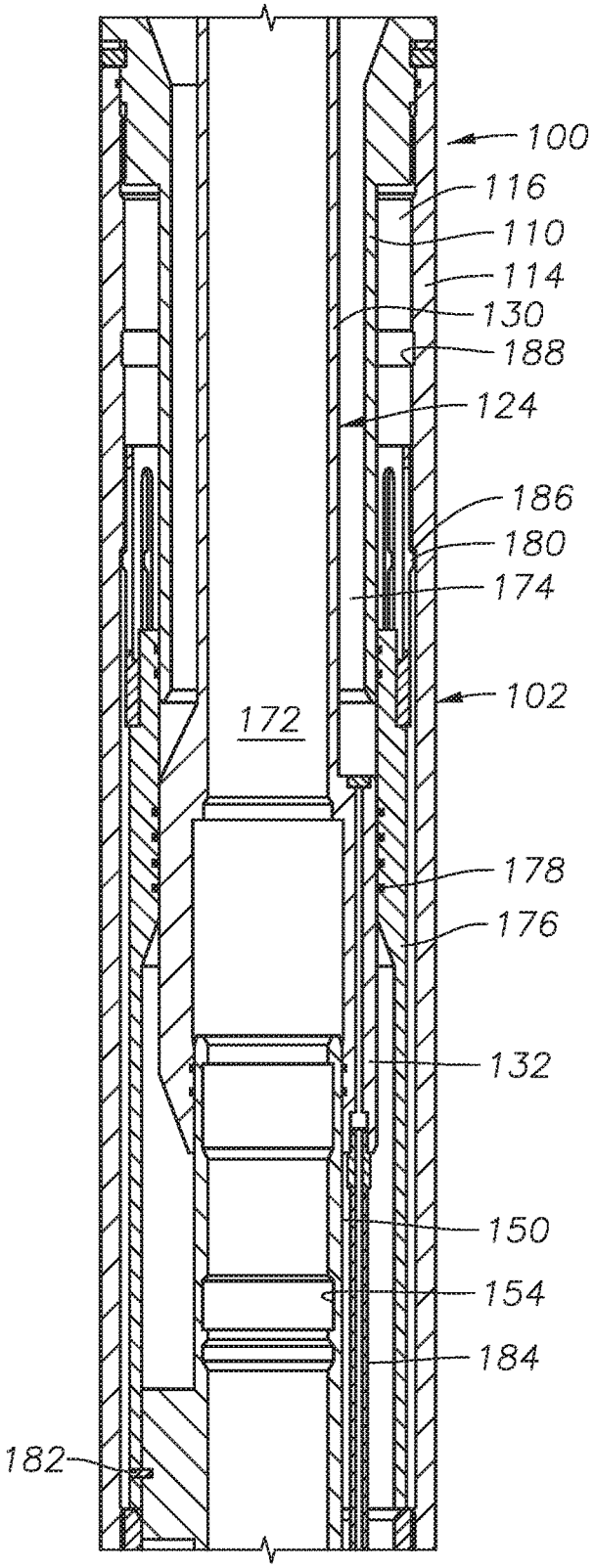

Together, housing assembly 102 and inner tubular assembly 124 define a substantially annular flow path 174. As previously described with reference to FIG. 1, annular flow path 174 is in fluid communication with upper sand screen assembly 16 and therefore upper zone 12. Disposed within annular flow path 174 is a sleeve 176 that has a plurality of seals 178 disposed on the inner surface thereof. Sleeve 176 is axially moveable between an open and closed positioned (FIG. 2B shows the closed position whereby flow path 174 does not allow fluid communication). In certain illustrative embodiments, sleeve 176 is threadably coupled to a collet assembly 180. Near its lower end, sleeve 176 is securably coupled to mandrel 150 via a threaded connector held in position by a pin 182 that extends through one of three radially expanded sections of mandrel 150 (only one being visible in the figures). Each of the radially expanded sections extends approximately thirty degrees in the circumferential direction such that the flow of fluid through annular flow path 174 is not prevented or substantially obstructed by the radially expanded sections. Also disposed within annular flow path 174 is an equalization pathway depicted as control line 184 that extends between tubular member 130 and communication sub 111.

A piston housing 113 is coupled to communication sub 111, and extends the length of mandrel 150. In this example, piston housing 113 comprises two parts joined together by a suitable coupler 121 and a seal 123. Piston housing 113 is coupled to communication sub 111 via another suitable coupler 125 and a seal 127. Communication sub 111 sealingly engages mandrel 150 using seals 129. A piston 115 is slidingly positioned inside housing 113 and surrounds mandrel 150. Piston housing 113 and piston 115 may be referred to herein as a piston assembly. One or more lugs 160 are positioned along piston 115 and, in this embodiment, held in place by piston housing 115 (which may also be referred to as lug retainer). Mandrel 150 includes a groove 151 which mates with lug 160.

Figure 2C:
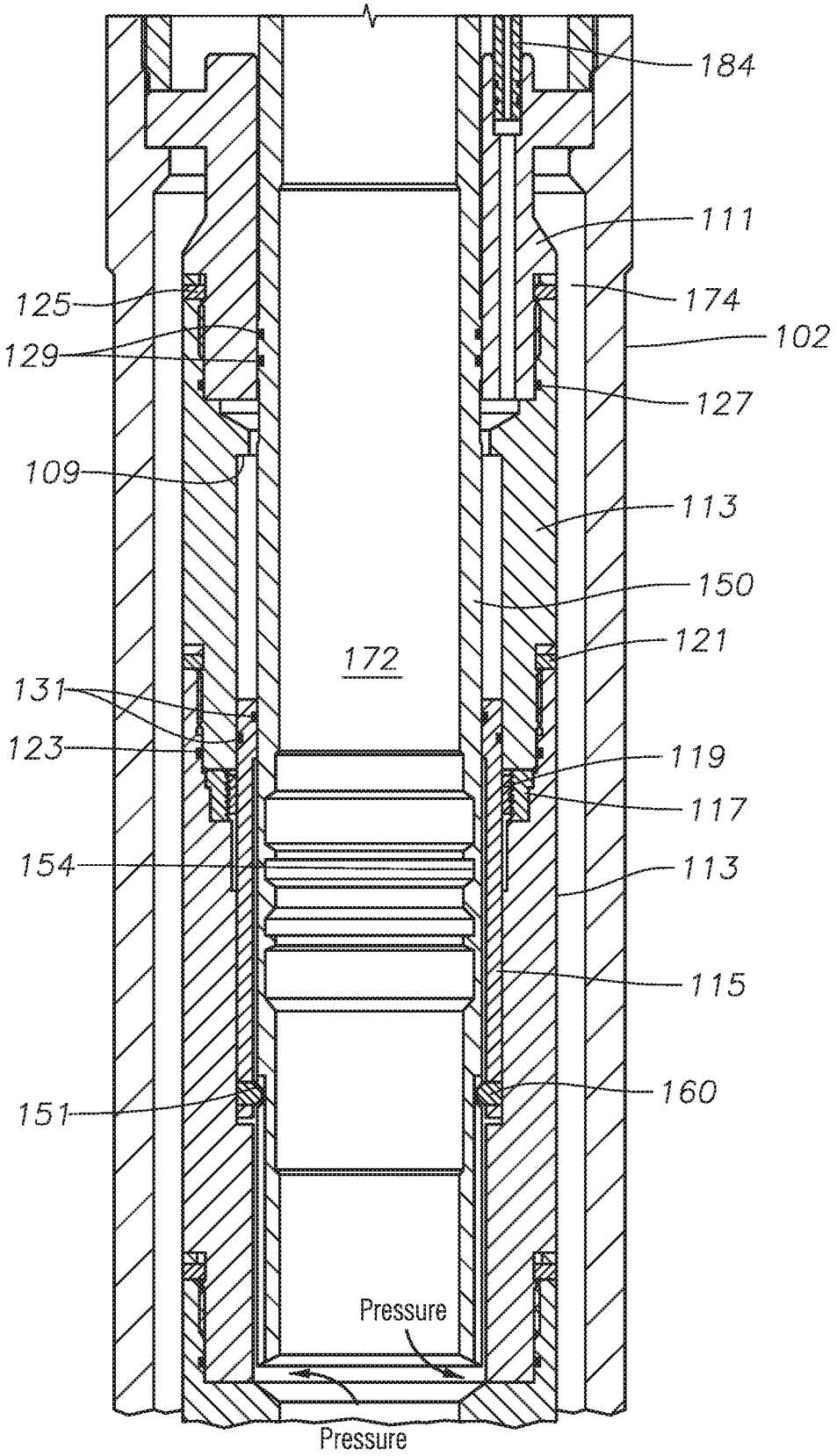

As will be described in various embodiments below, piston 115 is selectively coupled to mandrel 150. In the embodiment of FIG. 2C, piston 115 is selectively coupled to mandrel 150 via lugs 160. Piston housing 113 further includes a lock ring retainer 117 and a lock ring 119. As will be described herein, piston 115 is operable to receive pressure from central flow path 172 and thereby move mandrel 150 and sleeve 176 into the open position whereby fluid communication is allowed through annular flow path 174. Piston 115 includes seals 131 on its inner and outer surfaces, which enable piston 115 to be responsive to fluid pressure inside central flow path 172. Once in the open position, lock ring 119 engages the outer surface of piston 115, thereby "locking out" the piston, as will be described below. Thereafter, mandrel 150 is free to move relative to piston 115 and, thus, sleeve 176 is free to move between the open and closed positions.

The operation of tool 100 will now be described with reference to FIGS. 2A-2I. Tool 100 is initially run into the wellbore as part of the completion string with housing assembly 102 preferably forming a portion of the tubular string that extends to the surface. The completion string is the positioned at the desired location, such as that depicted in FIG. 1. Initially, tool 100 is in its closed position as depicted in FIGS. 2A-2C wherein sleeve 176 is in its lower position with seals 178 engaging an outer sealing surface of inner tubular member 130 such that fluid flow through annular flow path 174 is prevented. In this configuration, treatment or other operations requiring fluid flow and pressure fluctuations downhole of tool 100 are performed through central flow path 172. Even though pressure fluctuations are occurring in central flow path 172 and therefore to the lower area of mandrel 150, operation of tool 100 is prevented because of the pressure equalization of control line 184. Specifically, annular flow path 174 and central flow path 172 are in fluid communication with one another above tool 100. The pressure in annular flow path 174 above sleeve 176 is communicated across mandrel 150 via control line 184 that serves as a pathway to equalize pressure across mandrel assembly 150.

Figure 2D:
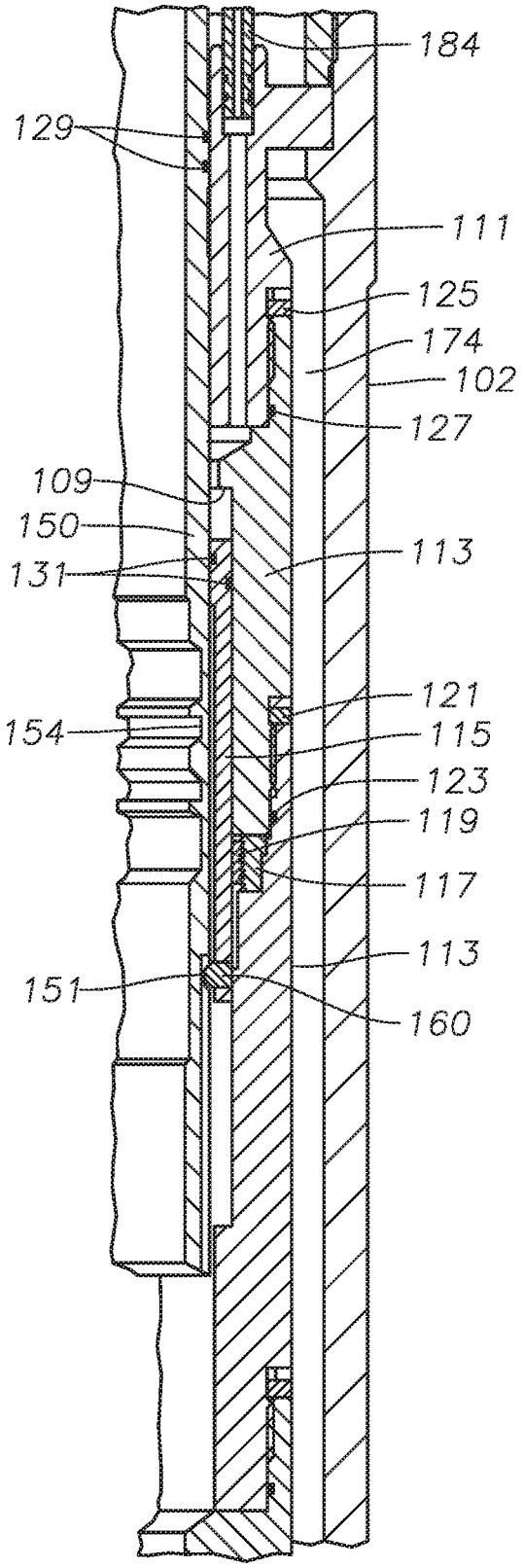

After treatment or other operations to the lower zone or zones are complete, the lower zones may be plugged off and a tubing string may be stabbed into polished bore receptacle 128 of inner tubular assembly 124. Here, for example, the lower zones may be plugged off by a ball valve installed in the tubing string below the tool; however, any kind of valve or plug installed below the tool that prevents fluid and pressure communication to the lower zones can be used. Nevertheless, in this configuration, annular flow path 174 and central flow path 172 are no longer in fluid communication with one another above tool 100. Now, increased pressure within central flow path 172 is communicated to lugs 160 and piston 115 via the entry point at the lower end of mandrel 150 (FIG. 2C). Because of seals 131, this pressure acts on piston 115 which, in turn using lugs 160 positioned inside groove 151, urges mandrel 150 in the uphole direction. Mandrel 150 is coupled to sleeve 176 and sleeve 176 is coupled to collet assembly 180. As best seen in FIG. 2D, collet assembly 180 selectively prevents upward movement of sleeve 176 and mandrel 150 until the pressure exerted on piston 115 exceeds a predetermined value sufficient to radially inwardly retract the collet fingers of collet assembly 180, to pass through a downwardly facing shoulder 186 of housing assembly 102.

When the predetermined value is reached and the collet fingers of collet assembly 180 are radially retracted, sleeve 176 and mandrel 150 shift in the uphole direction to the positions depicted in FIGS. 2D-2G. For simplicity, FIGS. 2D-2G only show partial views of tool 100. FIG. 2D shows the position of mandrel 150 and piston 115 when sleeve 176 is initially open and collet assembly 180 initially disengages. As piston 115 continues to move mandrel 150 upward, lock ring 119 ratchets on the outer surface of piston 115, as shown in FIG. 2H. As shown in FIG. 2H, the outer surface of piston 115 includes a ratchet surface 133 which mates with ratchet surfaces on lock ring 119, which in turn mates with the ratchet surface on lock ring retainer 117. As will be understood by those ordinarily skilled in the art having the benefit of this disclosure, the angle of ratchet surface 133 and its mating ratchet surface on lock ring 119, piston 115 is allowed to move in the uphole direction, but locked out from movement in the downhole direction.

Figure 2E:
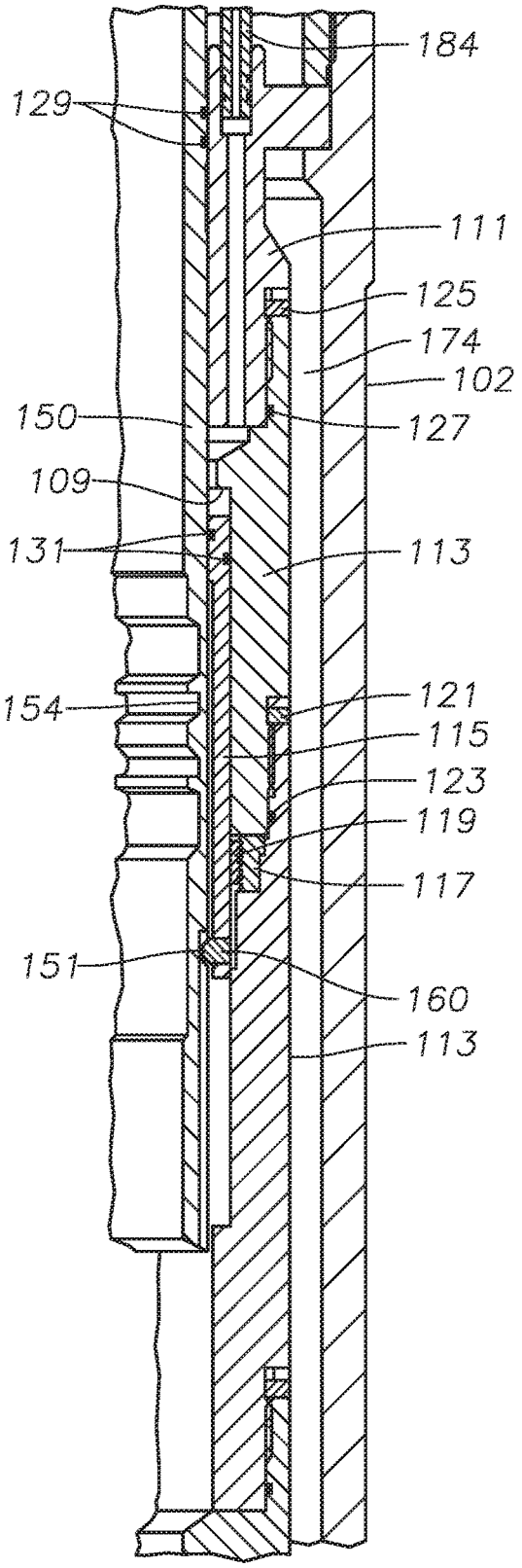
Figure 2F:
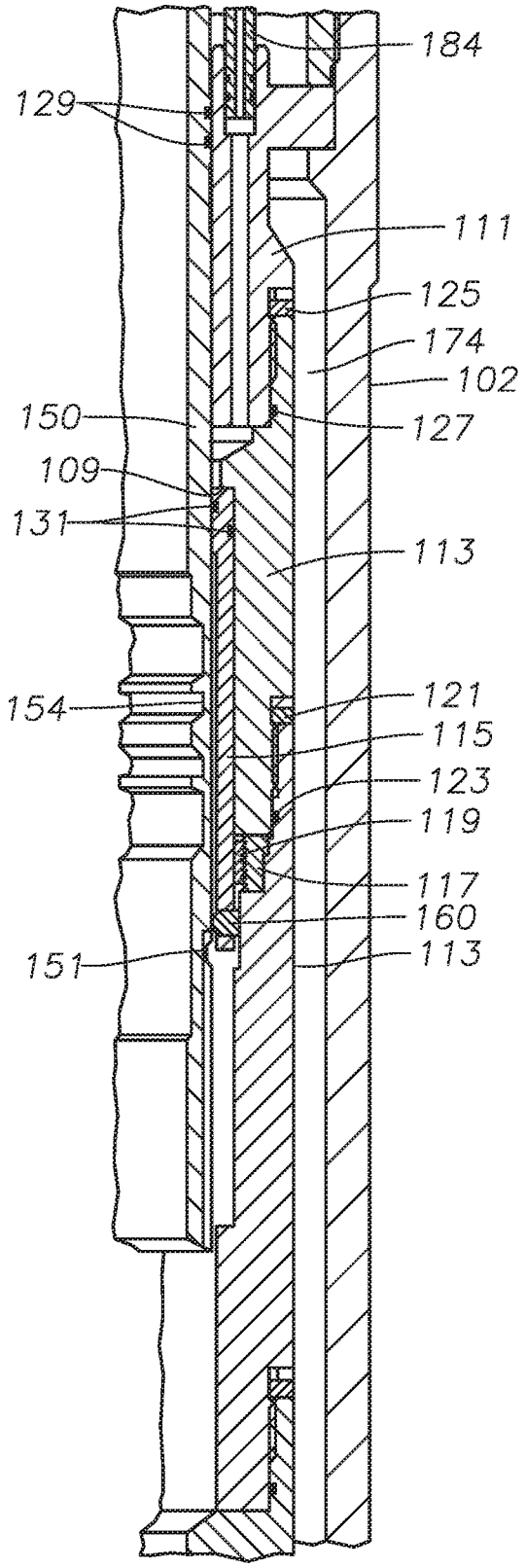
Figure 2G:
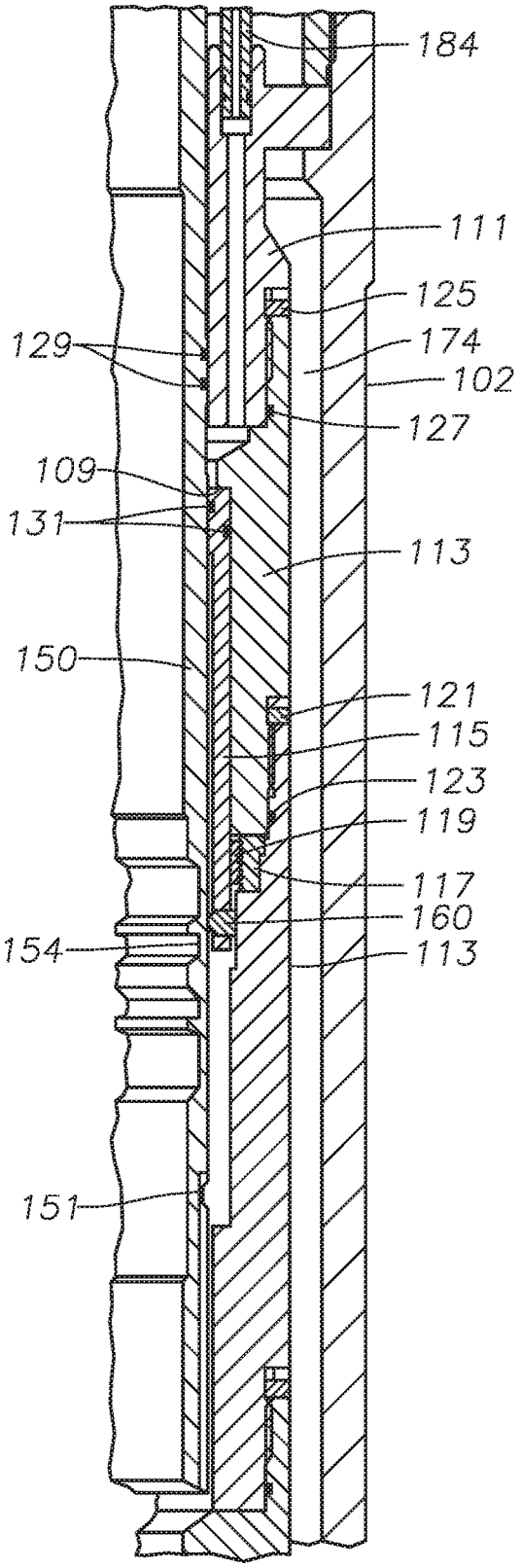
Figure 2H:
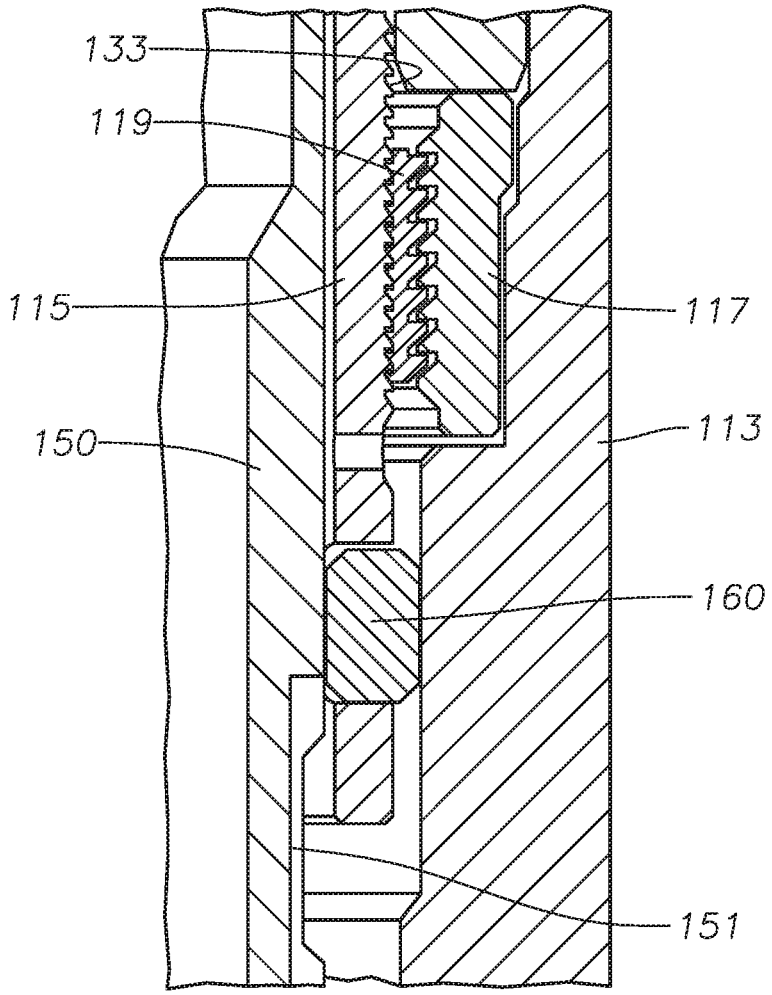
Figure 2I:
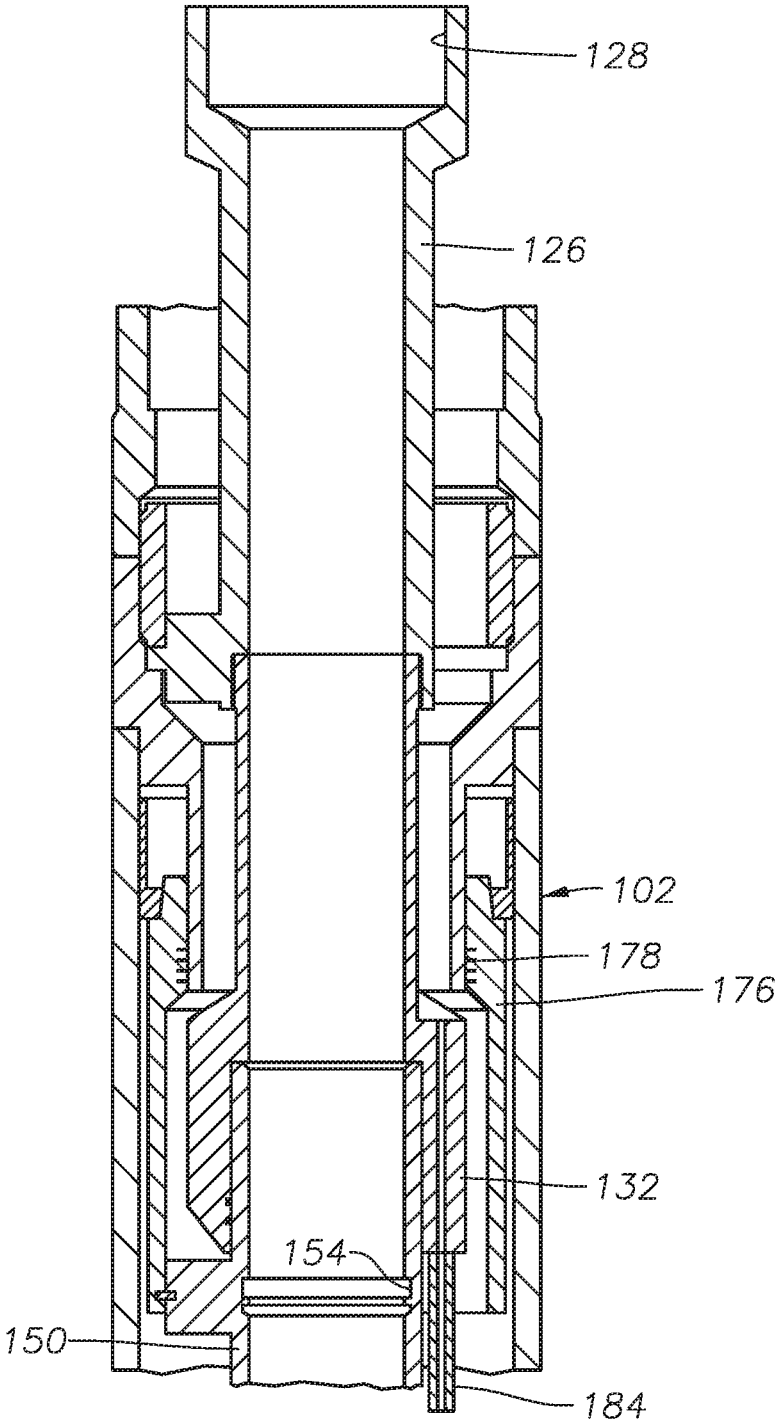

As illustrated in FIG. 2E, piston 115 and mandrel 150 continue to move upward until sleeve 176 has bottomed out, thus in the fully open position, as shown in FIG. 2I. Here, collet assembly 180 reengages with housing assembly 102 in annular recess 188. Sleeve 176 is in its upper position partially disposed within annular pocket 116 of housing assembly 102 with seals 178 engaging an outer sealing surface of housing extension 110. In this configuration, fluid communication between annular flow path 174 and the upper zone is allowed, enabling, for example, production from the upper zone into annular flow path 174. Importantly, in this configuration, seals 178 are protected from fluid flow or any abrasive materials therein as seals 178 are sealingly engaged with the outer sealing surface of housing extension 110 and out of the flow path. As such, seals 178 are not susceptible to damage during production from the upper zone or other fluid flow operations there through.

As pressure continues to be applied to piston 115, piston 115 will continue moving upward (because it has not bottomed out on shoulder 109) and lugs 160 will be forced out of groove 151 onto the larger outer surface of mandrel 150, as shown in FIG. 2F. At this point, piston 115 is fully disengaged from mandrel 150. Now, lock ring 119 engages ratchet surface 133 of piston 115, thereby preventing downward movement of piston 115 due to high differential pressures between the upper annular flow path 174 and central flow path 172 (i.e., upper and lower zones). Now, mandrel 150 and sleeve 176 are free to move relative to piston 115 in the upward or downward direction (i.e., open or closed positions), as shown in FIG. 2G showing mandrel 150 in the re-closed position.

When it is desired to return tool 100 from the open position to the closed position in certain illustrative methods, a shifting tool (e.g., lock mandrel and plug) may be run downhole on a conveyance (e.g., wireline) and positioned within tool 100. The lock mandrel and plug is operable to engage either of profiles 154 of mandrel 150. Once engaged, pressure is applied from the surface to the central flow path 172 moving mandrel 150 downhole, to reclose sleeve 176.

Figure 3:
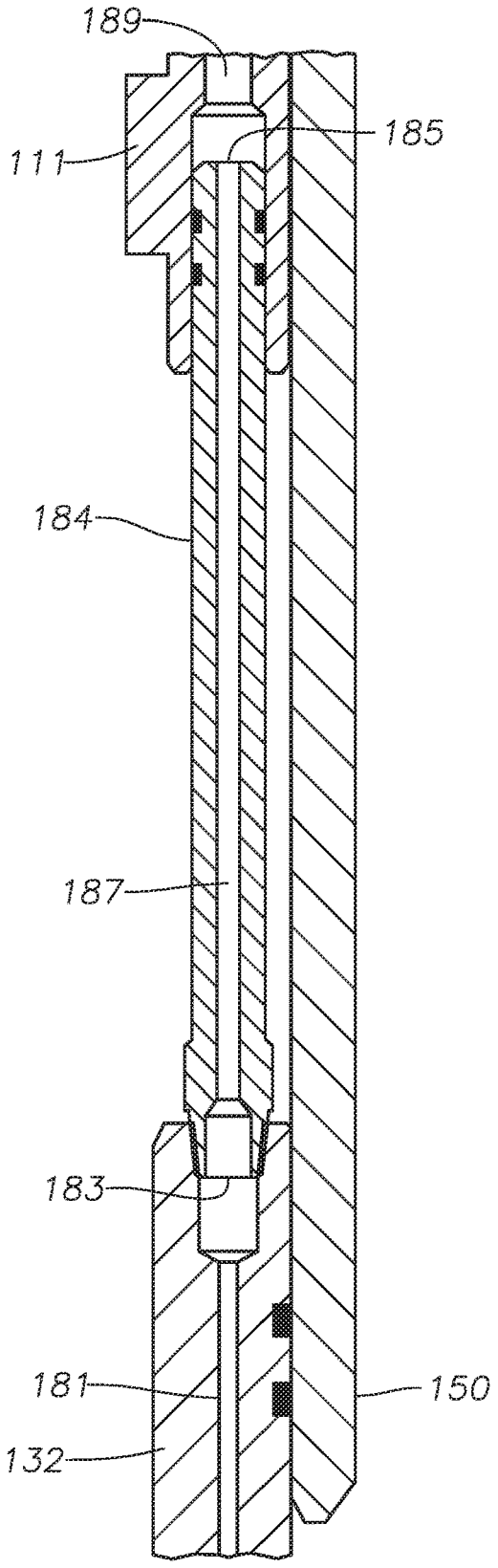
FIG. 3 illustrates an exploded view of a control line for pressure equalization, according to certain illustrative embodiments of the present disclosure.

FIG. 3 illustrates an exploded view of control line 184, according to certain illustrative embodiments of the present disclosure. In this example, control line 184 is a rigid stem having a first end 183, a second end 185, and a bore 187 extending there through. Another bore 181 of inner tubular 132 is in communication with bore 187, and provides fluid communication to annular flow area 176. At the lower end of control line 184 is another bore 189 of communication sub 111 which provides fluid communication to piston 115. As a result, only piston 115 sees a piston effect due to the differential pressure between the upper and lower zones. In order to achieve the rigidness, a variety of materials may be used for control line 184 including, for example, low-alloy steel, nickel alloy steel, stainless steel or other metals suitable for wellbore service with sufficient strength, rigidity, erosion resistance and corrosion resistance with the expected fluid environment. The use of a rigid stem allows for a more efficient design (e.g., less O-rings, machined parts, etc.) in comparison to conventional designs.

Figure 4A:
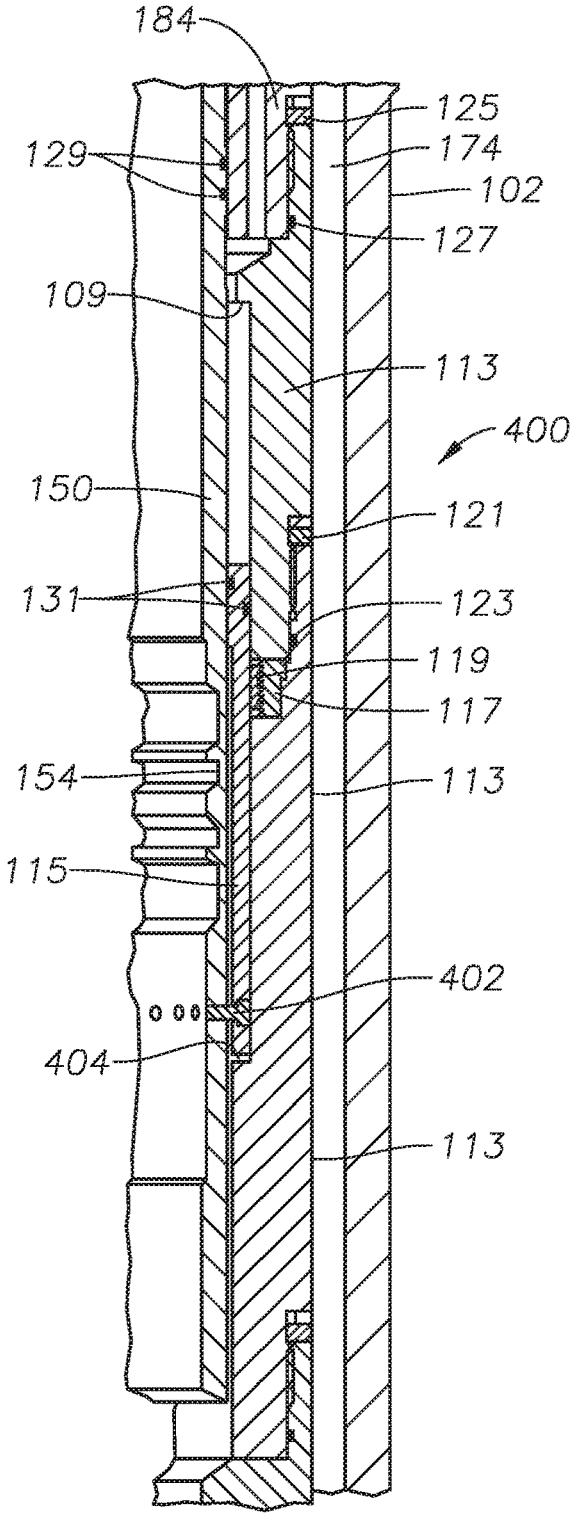
FIGS. 4A-4C are partial views of a multi-zone isolation tool using a shear screw, according to certain alternative embodiments of the present disclosure.
Figure 4B:
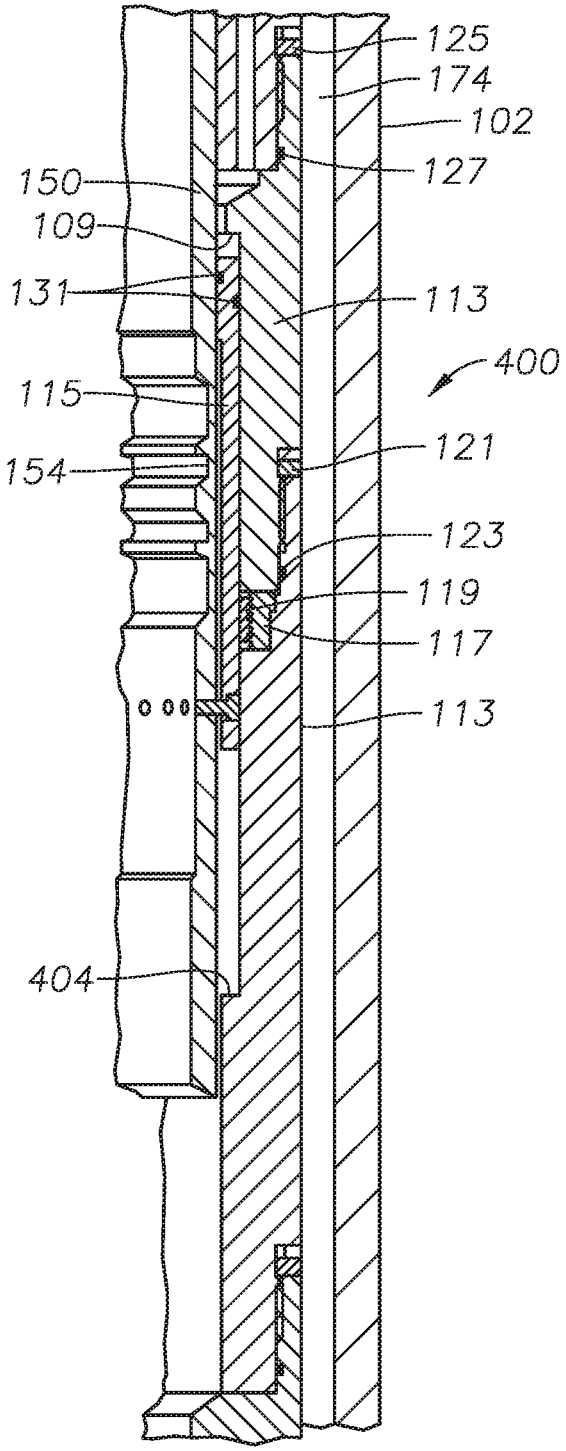
Figure 4C:
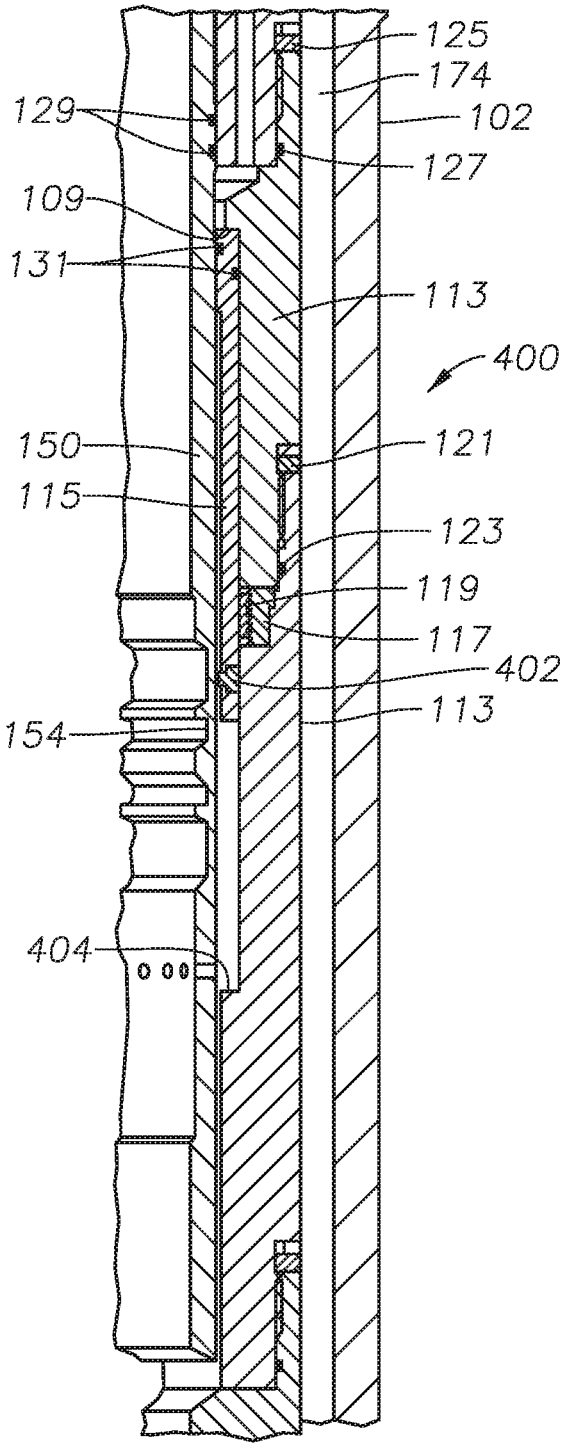

FIGS. 4A-4C are partial views of tool 400, according to certain alternative embodiments of the present disclosure. Tool 400 is similar to tool 100 previously described, using like numerals, and may therefore be understood with reference thereto. However, instead of lugs 160, tool 400 uses shear screws 402 to selectively couple to mandrel 150. In certain illustrative embodiments, shear screws 402 can withstand a 1.5 to 2 times greater than the force required to release collet assembly 180 to open sleeve 176, thereby providing a suitable safety margin. In the run in position, piston 115 and mandrel 150 are coupled to one another as shown in FIG. 4A. Note that piston 115 is bottomed out on shoulder 404 of piston housing 113 so that upper annulus pressure will not shear screws 402. When it is desired to open sleeve 176, pressure is applied to central flow path 172 as previously discussed. In turn, piston 115 and mandrel 150 move uphole until sleeve 176 bottoms out (FIG. 4B). However, because piston 115 has not yet bottomed out on shoulder 109, the pressure continues to act on piston 115 until shear screws 402 are sheared, as shown in FIG. 4C.

Once sheared, piston 115 is locked out by lock ring 119 as previously described. Alternatively, if the pressure applied is insufficient to shear screws 402, then piston 115 is still locked out by lock ring 119 and annulus pressure will still not cause sleeve 176 to re-close. In this case, shear screws 402 will be sheared when the tool is shifted closed using the shifting tools mentioned in a prior paragraph. Nevertheless, after shearing, mandrel 150 is free to move relative to piston 115 in the uphole or downhole directions, thereby opening and closing sleeve 176 as desired.

Figure 5A:
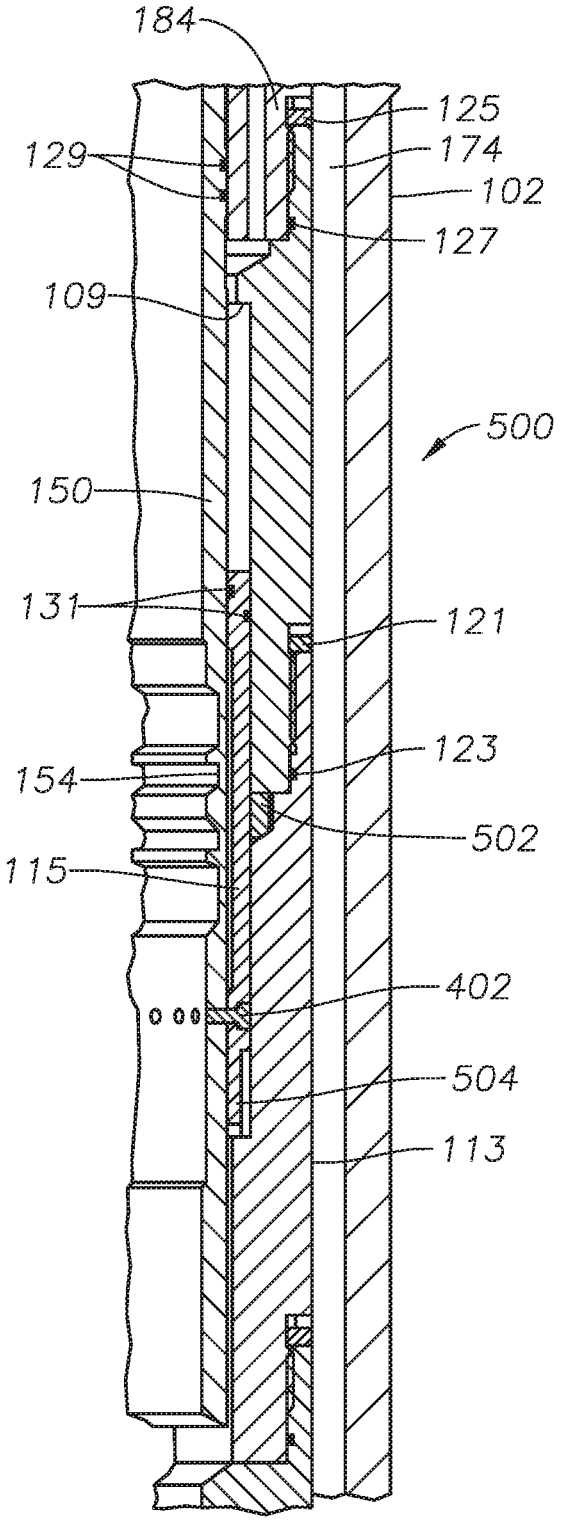
FIGS. 5A-5C are partial views of a multi-zone isolation tool using a snap ring, according to certain alternative embodiments of the present disclosure.
Figure 5B:
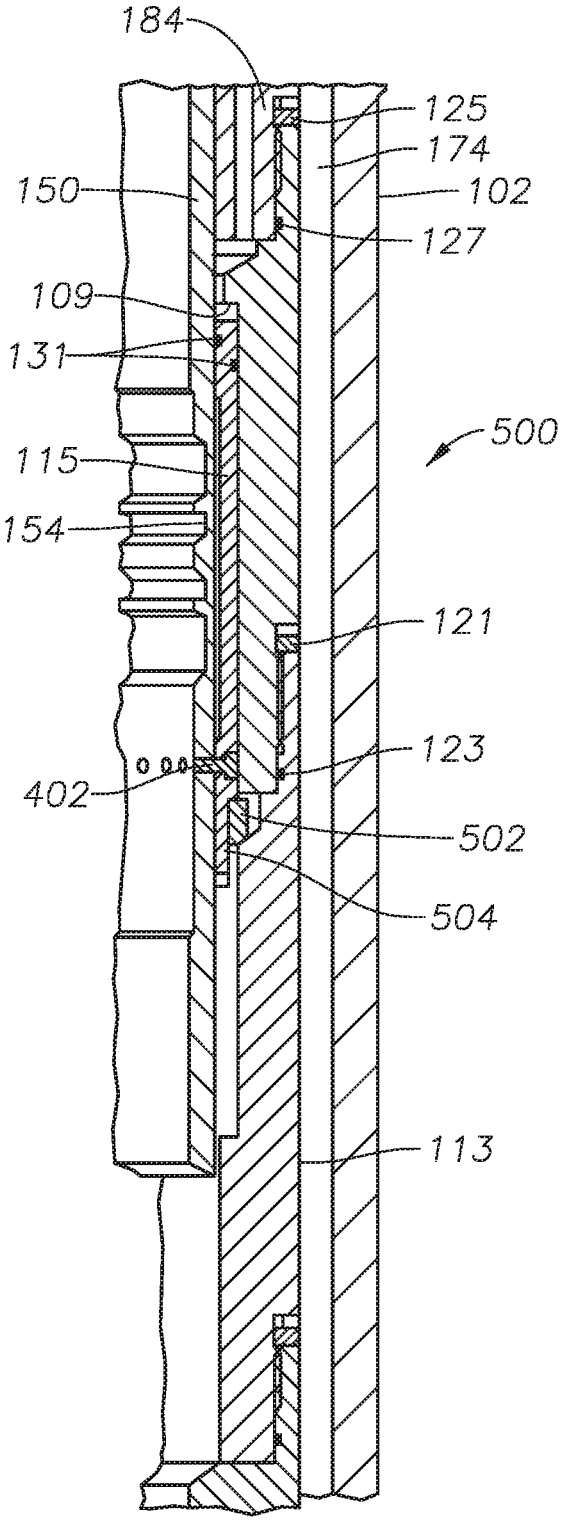
Figure 5C:
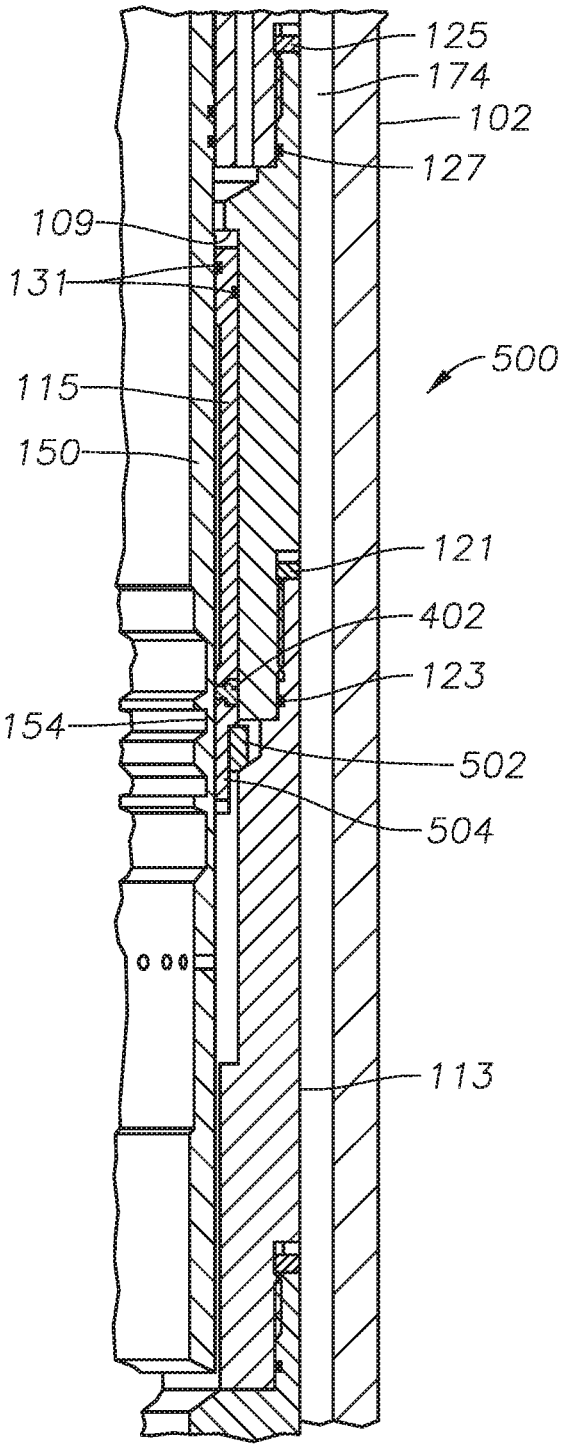

FIGS. 5A-5C are partial views of a tool 500, according to certain alternative embodiments of the present disclosure. Tool 500 is similar to tool 400 previously described, using like numerals, and may therefore be understood with reference thereto. However, tool 500 uses a snap ring 502 instead of a lock ring. In this example, piston 115 includes a groove 504 used to lock out piston 115. In the run in position as shown in FIG. 5A, mandrel 150 is in its lowermost position and sleeve 176 is closed. In FIG. 5B, fluid pressure is applied via central flow path 172 whereby piston 115 is forced uphole, along with mandrel 150 selectively coupled thereto by shear screws 402. Since the outer surface of piston 115 is smooth in this embodiment (i.e., no ratchet surface), snap ring 502 slidingly engages the outer surface of piston 115. As pressure continues to be applied, shear screw 402 is sheared and piston 115 bottoms out on shoulder 109. Once it bottoms out, snap ring 502 is now free to snap into groove 504, thus locking piston 115 in place, as shown in FIG. 5C. Thus, mandrel 150 is now free to move relative to piston 115 in either direction, as previously discussed.

Figure 6A:
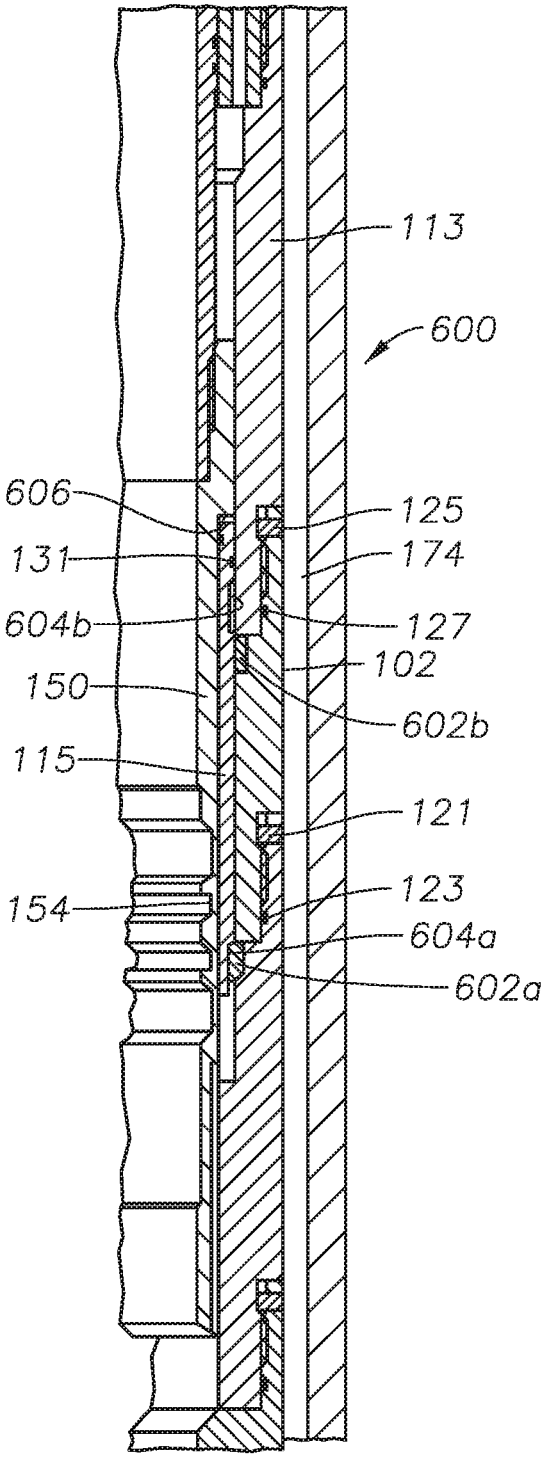
FIGS. 6A-6D are partial views of a multi-zone isolation tool using a snap ring, according to certain alternative embodiments of the present disclosure.
Figure 6B:
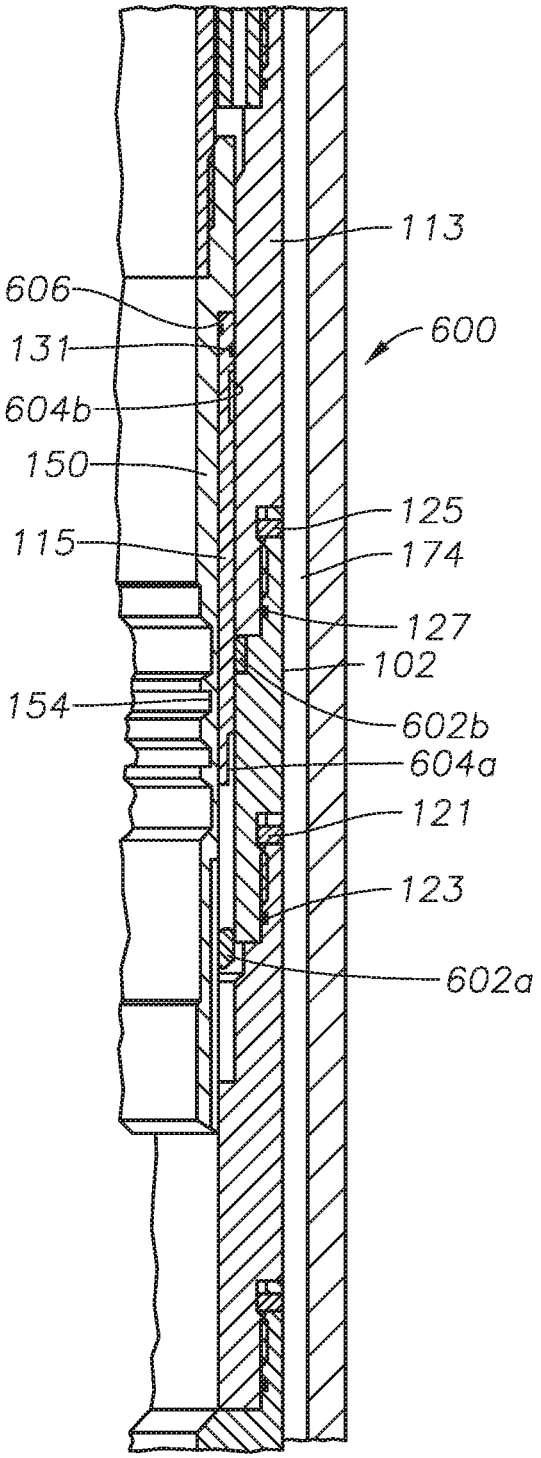

FIGS. 6A-6D are partial views of a tool 600, according to certain alternative embodiments of the present disclosure. Tool 600 is similar to tool 500 previously described, using like numerals, and may therefore be understood with reference thereto. However, tool 600 uses two snap rings and corresponding grooves. In this embodiment, piston 115 selectively couples directly to mandrel 150. Unlike previous embodiments, in tool 600, mandrel 150 includes a shoulder 606 at which piston 115 selectively couples to mandrel 150. In FIG. 6A, tool 600 is run in while in the closed position where a first snap ring 604*a* is positioned in a first groove 604*a* along the outer surface of piston 115. A second snap ring 602*b* is positioned in a groove along piston housing 113. In FIG. 6B, pressure has been applied to move piston 115 uphole along mandrel 150 until it bottoms out at shoulder 606, thereby selectively coupling piston 115 to mandrel 150 to move it uphole into the open position. At the same time, snap ring 602*a* slips out of groove 604*a* and rests along the outer surface of mandrel 150. Snap ring 602*b*, however, continues to slidingly engage along piston 115.

Figure 6C:
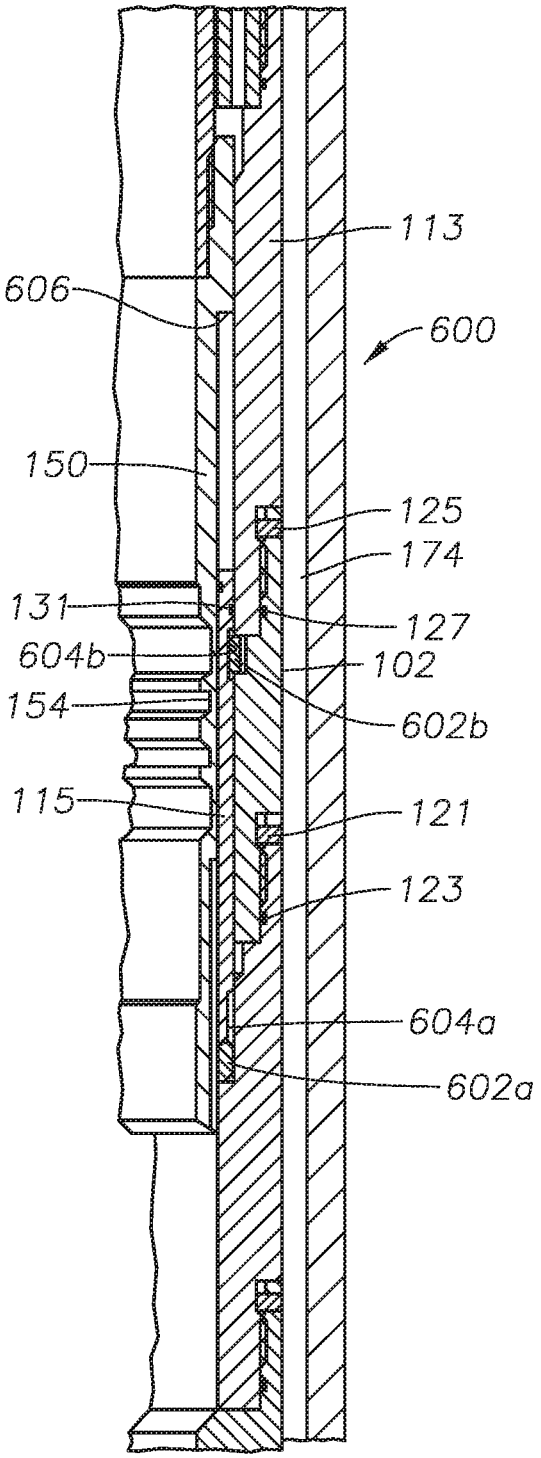
Figure 6D:
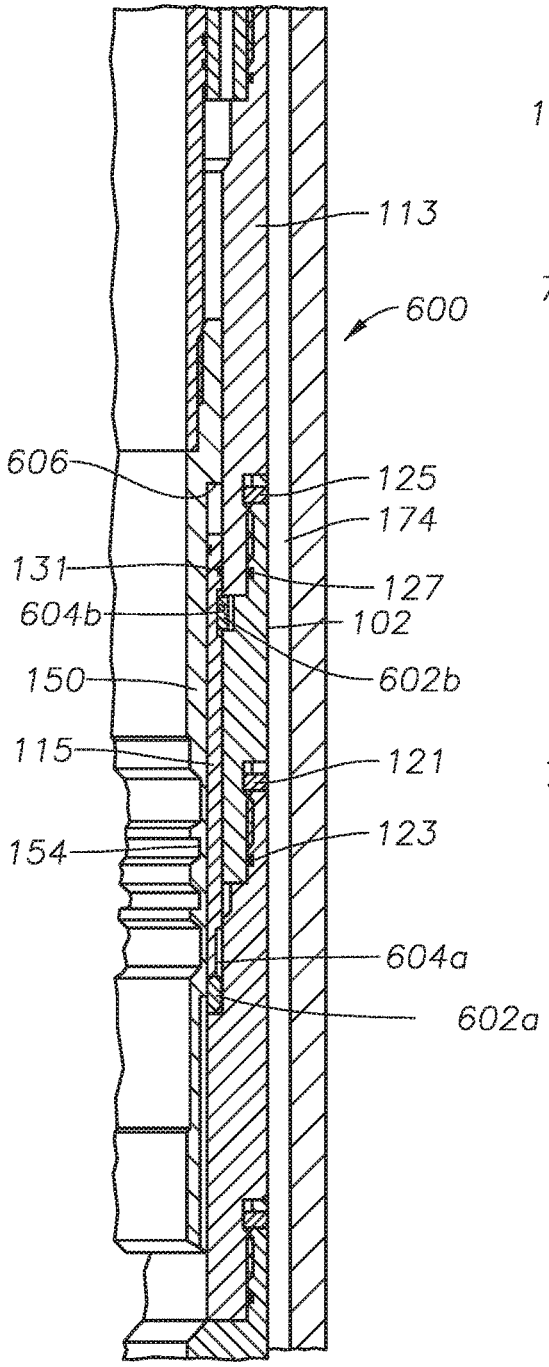

In the illustrative embodiment of tool 600, piston 115 will only become locked out if it moves lower than its run in position (likely due to higher upper annulus pressure) after tool 600 is initially opened, as shown in FIG. 6C. Snap ring 602*a* is required to keep piston 115 in the run position prior to the initial opening of sleeve 176. Once snap ring 602*b* snaps into groove 604*b*, piston 115 is locked out, and mandrel 150 may move up or down relative to piston 115 as shown in FIG. 6D. In alternate embodiments, snap ring 602*a* could be replaced with one or more shear screws that would connect piston 115 to piston housing 113. The shear screws would need to be sheared before tool 600 could be initially opened.

Figure 7:
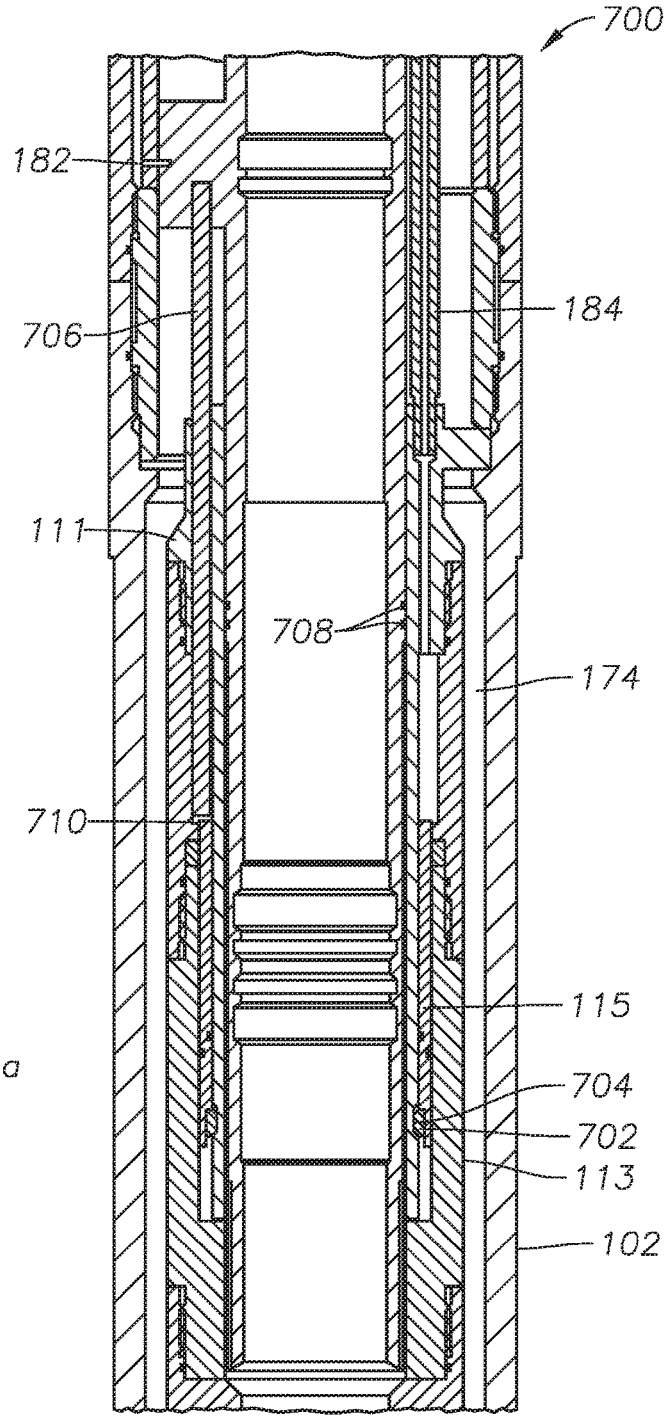
FIG. 7 is a view of a multi-zone isolation tool using pushing rods, according to certain alternative embodiments of the present disclosure.

FIG. 7 is a view of a tool 700, according to certain alternative embodiments of the present disclosure. Tool 700 is similar to the other tools described herein, using like numerals, and may therefore be understood with reference thereto. However, tool 700 includes a communication sub 111 which has been lengthened to provide an OD for piston 115 to seal against. Mandrel 150 includes seals 708 which prevent fluid pressure from communicating from central flow path 172 and up the area between mandrel 150 and communication sub 111. One or more rods 706 pass through holes in communication sub 111 and connect to mandrel 150 as shown. Piston 115 is selectively coupled to rods 706 at end 710 because, after mandrel 150 is moved to the open position, piston 115 is free to move back to the run in position shown in FIG. 7. During operation, mandrel 150 is in the closed position during run in. Here, a lug or snap ring 702 is positioned inside a groove along the inner surface of piston 115 (on one side) and another groove 704 along an inner surface of communication sub 111. Lug 702 prevents piston 115 from moving downhole beyond the run in position.

After tool 700 is positioned as desired, pressure is applied via central flow path 172 whereby piston 115 is urged uphole, whereby it then forces rods 706 uphole along with mandrel 150, thus opening sleeve 176. Although not shown, rods 706 will include seals to seal the between the rod and communication sub 111. Once opened, piston 115 will become locked out if it moves lower than its run in position (likely due to higher upper annulus pressure). If piston 115 moves lower than its run in position, lug 702 is forced out of groove 704 and toward piston 115, thus locking piston 115 out from further movement.

Figure 8A:
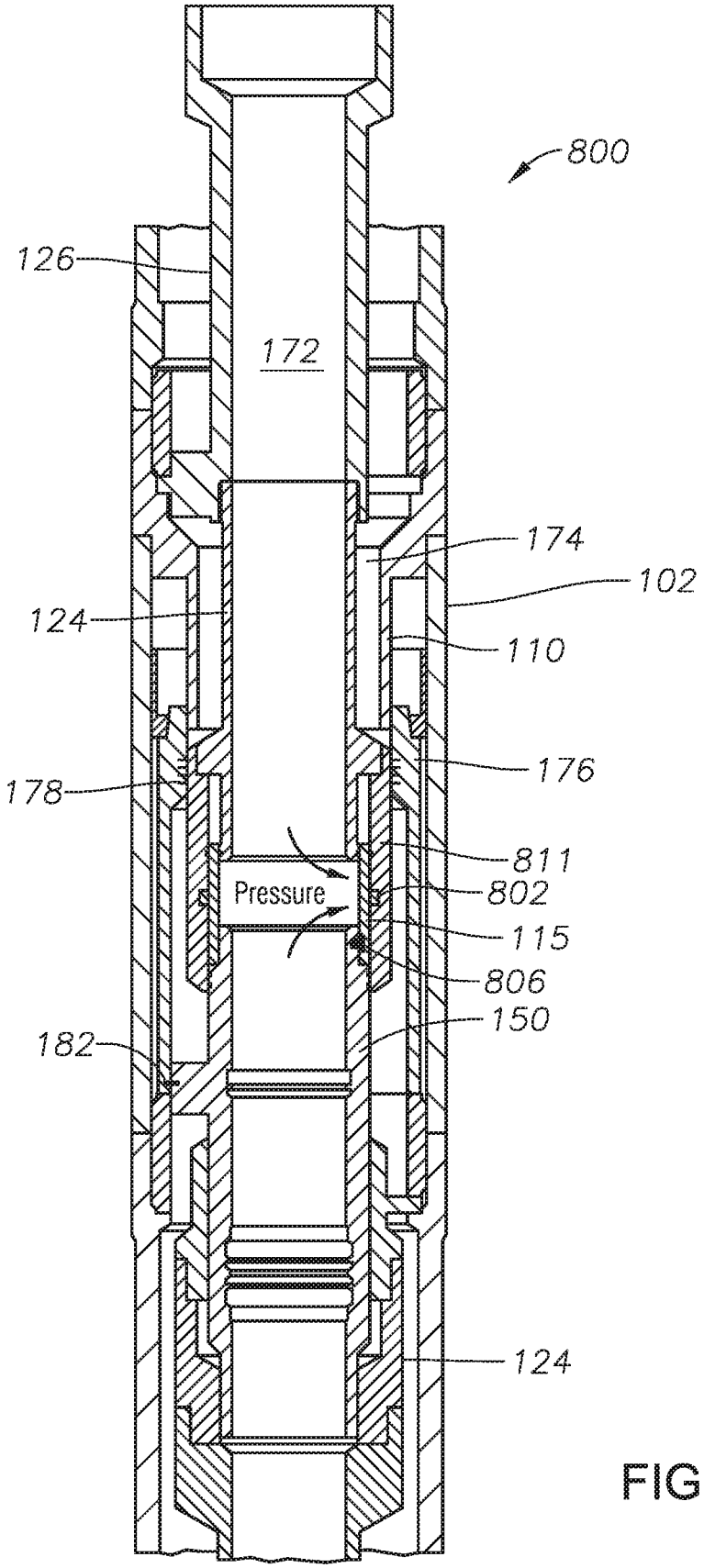
FIGS. 8A-8C are partial views of a multi-zone isolation tool in which the control line stem has been eliminated, according to certain alternative embodiments of the present disclosure.
Figure 8B:
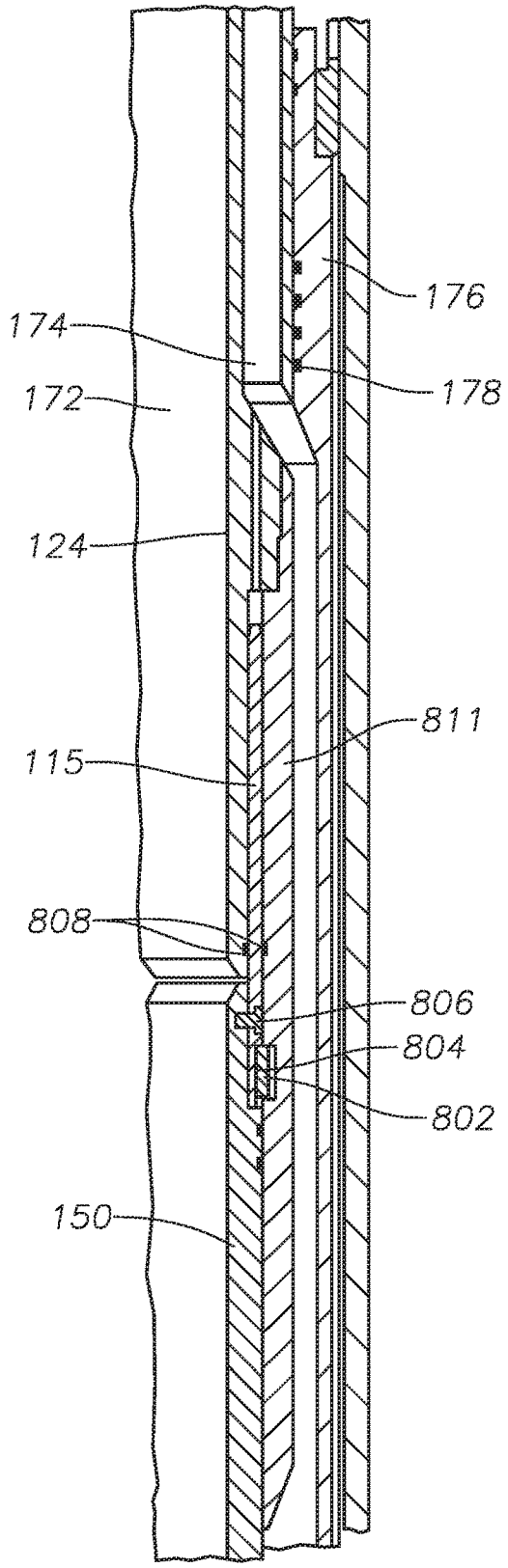
Figure 8C:
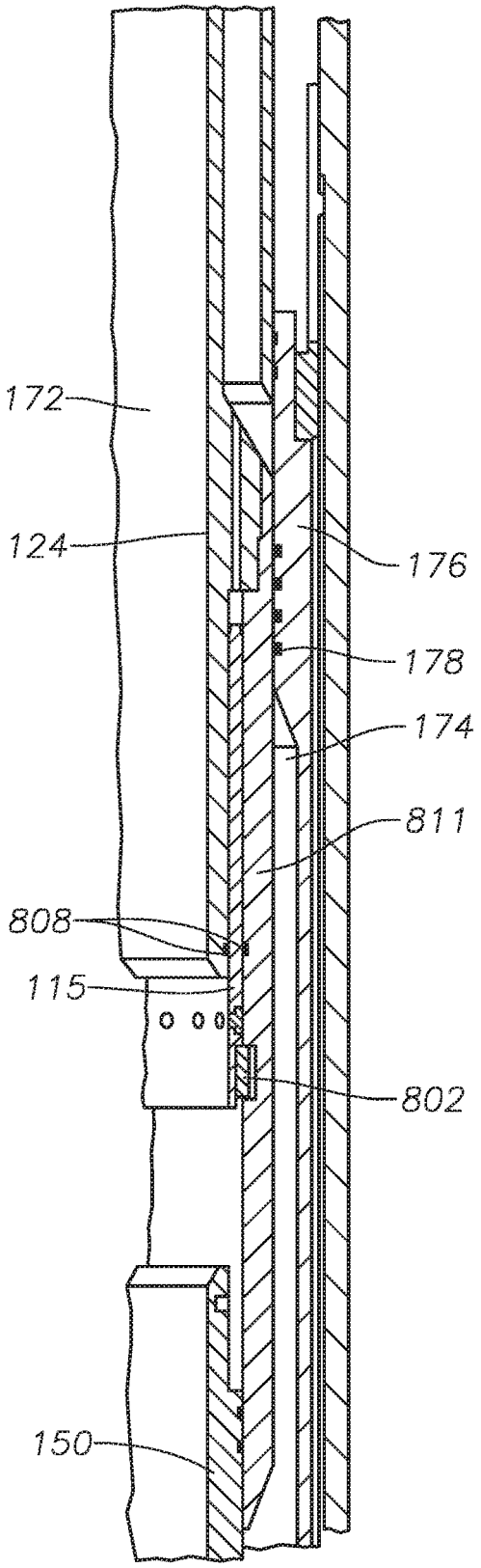

FIGS. 8A-8C are partial views of tool 800, according to yet other alternative embodiments of the present disclosure. Tool 800 is similar to the other tools described herein, using like numerals, and may therefore be understood with reference thereto. However, tool 800 does not use control line 184 (i.e., rigid stem) for equalization; instead, tool 800 uses a port 810 through flow sub 124 which puts piston 115 in fluid communication with the upper annulus. As a result, piston 115 can be moved underneath a sealing flow sub/piston housing 811 closer to sleeve 176. Piston 115 includes a groove where a snap ring 802 is positioned to slidingly move along an outer surface of piston 115. A shear screw 806 selectively couples piston 115 to mandrel 150. Piston 115 also includes a groove 804 at its lower end.

During operation, tool 800 is deployed downhole with mandrel 150 and sleeve 176 in the closed position as shown in FIG. 8A. Fluid pressure is applied via central flow path 172 at the location of seals 808 to urge piston 115 in the uphole direction. Seals 808 seal between inner tubular/flow sub 124 and piston 115 on one side, and seals between piston housing 811 and piston 115 on another side. The pressure in turn moves mandrel 150 upward as shown in FIG. 8B, whereby snap ring 802 snaps into groove 804, thereby locking piston 115 in place. When it is desired to move mandrel 150 back to the closed position as shown in FIG. 8C, the shifting tool as previously described is deployed and used to move the mandrel 150 as desired. Before movement however, shear screws 806 are sheared to free mandrel 150 so that it can be moved relative to piston 115 in either direction.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the illustrative term "below" can encompass both an orientation of above and below. The apparatus may be otherwise oriented (rotated 90 degrees or at other orientations) and the spatially relative descriptors used herein may likewise be interpreted accordingly.

Embodiments of the present disclosure described herein further relate to any one or more of the following paragraphs:

1. An apparatus for isolating a first zone from a second zone in a subterranean wellbore, the apparatus comprising an outer tubular; an inner tubular positioned within the outer tubular, thereby forming an annular flow path there between that is in fluid communication with the first zone, wherein the inner tubular defines a central flow path therein that is in fluid communication with the second zone; a sleeve positioned in the annular flow path to control fluid flow there through, the sleeve being axially moveable relative to the outer and inner tubular between a closed position and an open position; a mandrel slidingly positioned within the inner tubular and coupled to the sleeve, the mandrel being operable to shift the sleeve between the open and closed position; and a piston assembly positioned around the mandrel, the piston assembly comprising a piston housing; and a piston slidingly positioned within the piston housing and selectively coupled to the mandrel, the piston being operable to receive pressure from within the central flow path and thereby move the sleeve to the open position, wherein, once in the open position, the piston is operable to become locked out such that the mandrel is free to move relative to the piston and the sleeve is free to move between the open and closed positions.

2. An apparatus as defined in paragraph 1, wherein the piston comprises a lug which mates inside a groove positioned on the mandrel, thereby selectively coupling the piston to the mandrel; and the piston housing comprises a lock ring slidingly engaging an outer surface of the piston such that the piston is allowed to move relative to the lock ring in a first direction whereby the sleeve is in the open position, wherein, once in the open position, the piston is locked out from movement relative to the lock ring in a second direction opposite the first direction.

3. An apparatus as defined in paragraphs 1 or 2, wherein the piston comprises a shear screw that selectively couples the piston to the mandrel; and the piston housing comprises a lock ring slidingly engaging an outer surface of the piston such that the piston is allowed to move relative to the lock ring in a first direction whereby the sleeve is in the open position, wherein, once in the open position, the piston is locked out from movement relative to the lock ring in a second direction opposite the first direction, and wherein, once the shear screw is sheared, the piston is operable to move in the first and second directions.

4. An apparatus as defined in any of paragraphs 1-3, wherein the piston comprises a shear screw that selectively couples the piston to the mandrel; and the piston housing comprises a snap ring slidingly engaging an outer surface of the piston such that the piston is allowed to move relative to the snap ring in a first direction whereby the sleeve is in the open position, wherein, once in the open position, the snap ring mates with a groove on the outer surface of the piston, whereby the piston is locked out from movement relative to the snap ring in a second direction opposite the first direction.

5. An apparatus as defined in any of paragraphs 1-4, wherein the piston comprises a first snap ring positioned in a first groove along an outer surface of the piston while in a run position; and the piston housing comprises a second snap ring positioned in a groove along an inner surface of the piston housing; the mandrel comprises a shoulder that mates with an end of the piston, thereby selectively coupling the piston to the mandrel; the second snap ring slidingly engages the outer surface of the piston such that the piston is allowed to move relative to the snap ring in a first direction whereby the sleeve is in the open position; and the second snap ring mates with a second groove along an outer surface of the piston if the piston moves in a second direction opposite the first direction beyond the run position, whereby the piston is locked out from movement relative to second snap ring in the first and second directions.

6. An apparatus as defined in any of paragraphs 1-5, wherein the piston comprises a shear screw that selectively couples the piston to the piston housing while in a run position; and the piston housing comprises a snap ring positioned in a groove along an inner surface of the piston housing; the mandrel comprises a shoulder that mates with an end of the piston; the snap ring slidingly engages the outer surface of the piston such that the piston is allowed to move relative to the snap ring in a first direction whereby the sleeve is in the open position; and the snap ring mates with a second groove along an outer surface of the piston if the piston moves in a second direction opposite the first direction beyond the run position, whereby the piston is locked out from movement relative to snap ring in the first and second directions.

7. An apparatus as defined in any of paragraphs 1-6, wherein the apparatus further comprises a pushing rod coupled to the mandrel, wherein the piston selectively couples to the pushing rod to move the sleeve along a first direction into the open position; and a lug is positioned in a groove along an inner surface of the piston in a run position, wherein the lug prevents the piston from moving in a second direction opposite the first direction beyond the run position.

8. An apparatus as defined in any of paragraphs 1-7, wherein the piston comprises a shear screw that selectively couples the piston to the mandrel; the piston housing comprises a snap ring slidingly engaging an outer surface of the piston such that the piston is allowed to move relative to the snap ring in a first direction whereby the sleeve is in the open position; and the apparatus does not include an equalization stem, wherein, once in the open position, the snap ring mates with a groove on an outer surface of the piston, thereby locking the piston out from movement relative to the lock ring in a second direction opposite the first direction.

9. An apparatus as defined in any of paragraphs 1-8, further comprising an equalization pathway positioned within the annular flow path to selectively prevent actuation of the sleeve between the closed and open positions.

10. An apparatus as defined in any of paragraphs 1-9, wherein the equalization pathway comprises a rigid stem having a first end, second end opposite the first end, and a first fluid communication bore there through; a second fluid communication bore extending through the inner tubular and fluidly coupled to the first end of the rigid stem, the second fluid communication bore also being fluidly coupled to the annular flow area; and a third fluid communication bore fluidly coupled to the second end of the rigid stem, the third communication bore also being fluidly coupled to the piston housing.

11. An apparatus as defined in any of paragraphs 1-10, wherein the outer tubular comprises an extension that forms an annular pocket; and the sleeve comprises at least one seal on an inner surface thereof such that, in the closed position, the seal engages an outer surface of the inner tubular and, in the open position, the seal engages an outer surface of the extension of the outer tubular.

12. An apparatus as defined in any of paragraphs 1-11, further comprising a collet assembly coupled to the sleeve, the collect assembly selectively preventing shifting of the sleeve relative to the outer tubular when the sleeve is in the open and closed position.

13. A method for isolating a first zone from a second zone in a subterranean wellbore, the method comprising disposing a multi-zone isolation tool within the wellbore in a closed position, the tool having an inner tubular defining a central flow path and an outer tubular defining an annular flow path with the inner tubular, the annular flow path in fluid communication with the first zone, the central flow path in fluid communication with the second zone; varying pressure in the central flow path; in response to the pressure, moving a piston positioned around a mandrel slidingly disposed within the inner tubular, the piston being selectively coupled to the mandrel; shifting a sleeve coupled to the mandrel from the closed position, whereby the annular flow path is blocked, to an open position whereby the annular flow path is opened; uncoupling the piston from the mandrel; and locking out the piston such that the mandrel is free to move relative to the piston and the sleeve is free to move between the open and closed positions.

14. A method as defined in paragraph 13, wherein uncoupling the piston comprises forcing a piston lug out of a groove positioned on the mandrel; and locking out the piston comprises causing a lock ring to engage an outer surface of the piston such that the piston in allowed to move relative to the lock ring in a first direction whereby the sleeve is in the open position, but not in a second direction opposite the first direction.

15. A method as defined in paragraphs 13 or 14, wherein uncoupling the piston comprises shearing a shear screw coupling the piston to the mandrel; and locking out the piston comprises causing a lock ring to engage an outer surface of the piston such that the piston in allowed to move relative to the lock ring in a first direction whereby the sleeve is in the open position, but not in a second direction opposite the first direction.

16. A method as defined in any of paragraphs 13-15, wherein uncoupling the piston comprises shearing a shear screw coupling the piston to the mandrel; and locking out the piston comprises causing a snap ring to engage a groove on an outer surface of the piston such that the piston in allowed to move relative to the snap ring in a first direction whereby the sleeve is in the open position, but not in a second direction opposite the first direction.

17. A method as defined in any of paragraphs 13-16, wherein uncoupling the piston comprises causing the piston to come out of contact with a shoulder of the mandrel; and locking out the piston comprises causing a first snap ring to engage an end of the piston and a second snap ring to engage a groove on an outer surface of the piston such that the piston is held in place while the mandrel is allowed to move relative to the piston.

18. A method as defined in any of paragraphs 13-17, wherein uncoupling the piston comprises causing the piston to come out of contact with a shoulder of the mandrel after a shear screw connecting the piston to a piston housing has been sheared; and locking out the piston comprises causing a snap ring to engage a groove on an outer surface of the piston such that the piston is held in place while the mandrel is allowed to move relative to the piston.

19. A method as defined in any of paragraphs 13-18, wherein shifting the sleeve into the open position comprises causing the piston to move a pushing rod coupled to the mandrel in a first direction to the open position; uncoupling the piston comprises causing the piston to come out of contact with the pushing rod; and locking out the piston comprises using a snap ring positioned in a groove along an outer surface of the piston to prevent the piston from moving in a second direction opposite the first direction beyond a run position.

20. A method for isolating a first zone from a second zone in a subterranean wellbore, the method comprising disposing an apparatus into the wellbore and performing a downhole multi-zonal operation using the apparatus, wherein the apparatus is defined as in any of paragraphs 1-12.

Although various embodiments and methods have been shown and described, the present disclosure is not limited to such embodiments and methods and will be understood to include all modifications and variations as would be apparent to one skilled in the art. Therefore, it should be understood that this disclosure is not intended to be limited to the particular forms disclosed. Rather, the intention is to cover all modifications, equivalents and alternatives falling within the spirit and scope of the disclosure as defined by the appended claims.

What is claimed is:

1. An apparatus for isolating a first zone from a second zone in a subterranean wellbore, the apparatus comprising:

an outer tubular;

an inner tubular positioned within the outer tubular, thereby forming an annular flow path there between that is in fluid communication with the first zone, wherein the inner tubular defines a central flow path therein that is in fluid communication with the second zone;

a sleeve positioned in the annular flow path to control fluid flow there through, the sleeve being axially moveable relative to the outer and inner tubular between a closed position and an open position;

a mandrel slidingly positioned within the inner tubular and coupled to the sleeve, the mandrel being operable to shift the sleeve between the open and closed position; and a piston assembly positioned around the mandrel, the piston assembly comprising:

a piston housing; and a piston slidingly positioned within the piston housing and selectively coupled to the mandrel, the piston being operable to receive pressure from within the central flow path and thereby move the sleeve to the open position, wherein, once in the open position, the piston is operable to become locked out such that the mandrel is free to move relative to the piston and the sleeve is free to move between the open and closed positions;

wherein the piston comprises a shear screw that selectively couples the piston to the mandrel;

wherein the piston housing comprises a first snap ring slidingly engaging an outer surface of the piston such that the piston is allowed to move relative to the first snap ring in a first direction whereby the sleeve is in the open position; and wherein, once in the open position, the first snap ring mates with a groove on the outer surface of the piston, whereby the piston is locked out from movement relative to the first snap ring in a second direction opposite the first direction.

2. An apparatus as defined in claim 1, wherein:

the piston housing comprises a second snap ring positioned in a groove along an inner surface of the piston housing;

the mandrel comprises a shoulder that mates with an end of the piston, thereby selectively coupling the piston to the mandrel;

the second snap ring slidingly engages the outer surface of the piston such that the piston is allowed to move relative to the snap ring in a first direction whereby the sleeve is in the open position; and the second snap ring mates with a second groove along an outer surface of the piston if the piston moves in a second direction opposite the first direction beyond the run position, whereby the piston is locked out from movement relative to second snap ring in the first and second directions.

3. An apparatus as defined in claim 1, wherein:

the first snap ring is positioned in a first groove along an inner surface of the piston housing;

the mandrel comprises a shoulder that mates with an end of the piston; and the first snap ring mates with a second groove along an outer surface of the piston if the piston moves in a second direction opposite the first direction beyond the run position, whereby the piston is locked out from movement relative to snap ring in the first and second directions.

4. An apparatus as defined in claim 1, further comprising an equalization pathway positioned within the annular flow path to selectively prevent actuation of the sleeve between the closed and open positions.

5. An apparatus as defined in claim 4, wherein the equalization pathway comprises:

a rigid stem having a first end, second end opposite the first end, and a first fluid communication bore there through;

a second fluid communication bore extending through the inner tubular and fluidly coupled to the first end of the rigid stem, the second fluid communication bore also being fluidly coupled to the annular flow area; and a third fluid communication bore fluidly coupled to the second end of the rigid stem, the third communication bore also being fluidly coupled to the piston housing.

6. An apparatus as defined in claim 1, wherein:

the outer tubular comprises an extension that forms an annular pocket; and the sleeve comprises at least one seal on an inner surface thereof such that, in the closed position, the seal engages an outer surface of the inner tubular and, in the open position, the seal engages an outer surface of the extension of the outer tubular.

7. An apparatus as defined in claim 1, further comprising a collet assembly coupled to the sleeve, the collect assembly selectively preventing shifting of the sleeve relative to the outer tubular when the sleeve is in the open and closed position.

8. An apparatus for isolating a first zone from a second zone in a subterranean wellbore, the apparatus comprising:

an outer tubular;

an inner tubular positioned within the outer tubular, thereby forming an annular flow path there between that is in fluid communication with the first zone, wherein the inner tubular defines a central flow path therein that is in fluid communication with the second zone;

a sleeve positioned in the annular flow path to control fluid flow there through, the sleeve being axially moveable relative to the outer and inner tubular between a closed position and an open position;

a mandrel slidingly positioned within the inner tubular and coupled to the sleeve, the mandrel being operable to shift the sleeve between the open and closed position; and a piston assembly positioned around the mandrel, the piston assembly comprising:

a piston housing; and a piston slidingly positioned within the piston housing and selectively coupled to the mandrel, the piston being operable to receive pressure from within the central flow path and thereby move the sleeve to the open position, wherein, once in the open position, the piston is operable to become locked out such that the mandrel is free to move relative to the piston and the sleeve is free to move between the open and closed positions;

wherein the piston comprises a shear screw that selectively couples the piston to the mandrel;

the piston housing comprises a snap ring slidingly engaging an outer surface of the piston such that the piston is allowed to move relative to the snap ring in a first direction whereby the sleeve is in the open position; and the apparatus does not include an equalization stem, wherein, once in the open position, the snap ring mates with a groove on an outer surface of the piston, thereby locking the piston out from movement relative to the lock ring in a second direction opposite the first direction.

9. A method for isolating a first zone from a second zone in a subterranean wellbore, the method comprising:

disposing a multi-zone isolation tool within the wellbore in a closed position, the tool having an inner tubular defining a central flow path and an outer tubular defining an annular flow path with the inner tubular, the annular flow path in fluid communication with the first zone, the central flow path in fluid communication with the second zone;

varying pressure in the central flow path;

in response to the pressure, moving a piston positioned around a mandrel slidingly disposed within the inner tubular, the piston being selectively coupled to the mandrel;

shifting a sleeve coupled to the mandrel from the closed position, whereby the annular flow path is blocked, to an open position whereby the annular flow path is opened;

uncoupling the piston from the mandrel; and locking out the piston such that the mandrel is free to move relative to the piston and the sleeve is free to move between the open and closed positions; wherein uncoupling the piston comprises shearing a shear screw coupling the piston to the mandrel; and locking out the piston comprises causing a first snap ring to engage a groove on an outer surface of the piston such that the piston in allowed to move relative to the first snap ring in a first direction whereby the sleeve is in the open position, but not in a second direction opposite the first direction.

10. A method as defined in claim 9, wherein:

uncoupling the piston further comprises causing the piston to come out of contact with a shoulder of the mandrel; and locking out the piston comprises causing the first snap ring to engage an end of the piston and a second snap ring to engage a groove on an outer surface of the piston such that the piston is held in place while the mandrel is allowed to move relative to the piston.

11. A method as defined in claim 9, wherein:

uncoupling the piston comprises causing the piston to come out of contact with a shoulder of the mandrel after the shear screw connecting the piston to a piston housing has been sheared; and locking out the piston further comprises causing the first snap ring to engage the groove on an outer surface of the piston such that the piston is held in place while the mandrel is allowed to move relative to the piston.

12. A method as defined in claim 9, wherein:

shifting the sleeve into the open position comprises causing the piston to move a pushing rod coupled to the mandrel in a first direction to the open position;

uncoupling the piston comprises causing the piston to come out of contact with the pushing rod; and locking out the piston further comprises using the first snap ring positioned in a groove along an outer surface of the piston to prevent the piston from moving in a second direction opposite the first direction beyond a run position.

* * * * *